US007530193B2

(12) United States Patent
Williamson, IV et al.

(10) Patent No.: US 7,530,193 B2
(45) Date of Patent: May 12, 2009

(54) APPARATUS AND METHOD FOR INDICATING TILT

(75) Inventors: Warren P. Williamson, IV, Loveland, OH (US); David C. Yates, Westchester, OH (US); Craig B. Berky, Milford, OH (US)

(73) Assignee: Long-Shot Products, Ltd., Loveland, OH (US)

( * ) Notice: Subject to any disclaimer, the term of this patent is extended or adjusted under 35 U.S.C. 154(b) by 0 days.

(21) Appl. No.: 11/301,907

(22) Filed: Dec. 13, 2005

(65) Prior Publication Data

US 2006/0101700 A1 May 18, 2006

Related U.S. Application Data

(63) Continuation of application No. 10/808,197, filed on Mar. 24, 2004, now Pat. No. 6,978,569, which is a continuation of application No. PCT/US02/29656, filed on Sep. 19, 2002.

(60) Provisional application No. 60/326,828, filed on Oct. 3, 2001.

(51) Int. Cl.
*F41G 1/44* (2006.01)

(52) U.S. Cl. ..... 42/145; 42/132

(58) Field of Classification Search ..... 42/113, 42/132, 137, 144, 145; 33/275 G, 273
See application file for complete search history.

(56) References Cited

U.S. PATENT DOCUMENTS

| | | | | |
|---|---|---|---|---|
| 2,173,727 | A | | 9/1939 | Ramstrum |
| 2,977,559 | A | | 3/1961 | Rosenberg et al. |
| 3,114,209 | A | | 12/1963 | Foody et al. |
| 3,299,523 | A | | 1/1967 | Lea |
| 3,492,736 | A | * | 2/1970 | Erenburg et al. ..... 33/324 |
| 3,682,552 | A | | 8/1972 | Hartman |
| 3,737,232 | A | | 6/1973 | Milburn, Jr. |
| 3,747,222 | A | | 7/1973 | Benoit |
| 3,824,699 | A | * | 7/1974 | Lenz et al. ..... 33/334 |
| 3,914,873 | A | | 10/1975 | Elliott, Jr. et al. |
| 3,945,127 | A | | 3/1976 | Spencer |
| 3,997,974 | A | | 12/1976 | Larson |
| 4,070,763 | A | | 1/1978 | Carts, Jr. |
| 4,110,609 | A | | 8/1978 | Beer |
| 4,142,297 | A | | 3/1979 | Altier |
| 4,159,422 | A | | 6/1979 | Okubo |

(Continued)

FOREIGN PATENT DOCUMENTS

| | | |
|---|---|---|
| CA | 978737 | 12/1975 |

(Continued)

OTHER PUBLICATIONS

Robert A. Moses, M.D., Adler's Physiology of the Eye, 1970, 6 pgs.

*Primary Examiner*—Stephen M Johnson
(74) *Attorney, Agent, or Firm*—Wood, Herron & Evans, L.L.P.

(57) ABSTRACT

A tilt indicator for use on a firearm includes a signal to indicate if the firearm is level or out of level. The signal is located to be viewed by a user via the user's peripheral vision and his secondary concentration so the user can maintain his primary concentration on the target.

22 Claims, 12 Drawing Sheets

U.S. PATENT DOCUMENTS 4,163,325 A 8/1979 Hughes
4,170,071 A 10/1979 Mann et al.
4,177,572 A 12/1979 Hindes
4,179,613 A * 12/1979 Koren ..... 250/215
4,195,414 A 4/1980 Robinson
4,215,484 A 8/1980 Lauffenburger
4,312,131 A 1/1982 Scriffignana et al.
4,325,190 A 4/1982 Duerst
4,536,967 A 8/1985 Beitzer
4,561,204 A 12/1985 Binion
4,689,887 A 9/1987 Colvin
4,792,673 A 12/1988 Blackler
4,859,058 A 8/1989 Ekstrand
4,877,324 A 10/1989 Hauri et al.
4,884,809 A 12/1989 Rowan
4,894,921 A 1/1990 Barlow
5,005,308 A * 4/1991 Parks ..... 42/122
5,152,068 A 10/1992 Meister et al.
5,157,839 A 10/1992 Beutler
5,223,650 A 6/1993 Finn
5,224,385 A 7/1993 Floris et al.
5,303,495 A 4/1994 Harthcock
5,315,781 A 5/1994 Beisner
5,339,227 A 8/1994 Jones
5,349,853 A 9/1994 Oehler
5,406,733 A 4/1995 Tarlton et al.
5,435,068 A 7/1995 Thames et al.
5,491,546 A 2/1996 Wascher et al.
5,537,201 A * 7/1996 Kumagai et al. ..... 356/4.08
5,619,801 A 4/1997 Slates
5,630,279 A 5/1997 Slates
5,634,278 A * 6/1997 London ..... 42/132
5,657,571 A * 8/1997 Peterson ..... 42/122
5,777,899 A 7/1998 Kumagai
5,914,775 A 6/1999 Hargrove et al.
5,952,992 A * 9/1999 Helms ..... 345/102
6,082,012 A 7/2000 McLeod
6,108,919 A * 8/2000 Wu et al. ..... 33/292
6,237,235 B1 5/2001 Feist et al.
6,302,714 B1 * 10/2001 Bolognia et al. ..... 439/157
6,311,405 B1 11/2001 Slates
6,494,604 B2 12/2002 Khoshnood
6,516,551 B2 2/2003 Gaber
6,654,975 B2 * 12/2003 Broker ..... 8/159

FOREIGN PATENT DOCUMENTS

DE 3401855 A1 7/1985
WO 2004099700 A1 11/2004

* cited by examiner

APPARATUS AND METHOD FOR INDICATING TILT

The present application is a continuation of U.S. application Ser. No. 10/808,197, filed on Mar. 24, 2004, now U.S. Pat. No. 6,978,569, which is a continuation of PCT Ser. No. PCT/US02/29656 filed on Sep. 19, 2002, now expired, claiming the benefit of provisional patent application Ser. No. 60/326,828, filed on Oct. 3, 2001, now abandoned. The disclosures of each of these prior related applications are hereby fully incorporated by reference herein.

TECHNICAL FIELD OF THE INVENTION

The present invention relates to the general art of firearms, and to the particular field of controlling and aiming the firearm during use.

BACKGROUND OF THE INVENTION

The sport of target shooting has become very popular in recent years. This sport has taken several forms, including the use of rifles, hand guns, air guns and the like. Furthermore, many overall competitions, such as modern pentathlon, include a section of target shooting of some sort. Obviously, accuracy is of prime importance in such competitions. Modern competitions have become so close that unaided aiming of a firearm may be insufficient.

While accuracy and precision are extremely important to target shooters, such considerations are also important to other applications, including but not limited to, hunting and military applications. Accordingly, while the present disclosure specifies target shooting, it is understood that it is equally applicable to other applications.

There have been many improvements to the standard firearm intended to increase the marksman's accuracy and ability to hit a target. The development of telescopic sights, also known as scopes, is one of the earliest improvements in this area. Scopes are used to improve viewing of the target such as via optical magnification, to determine where the projectile will land.

The way a firearm is held by the user can have an impact on the firearm accuracy which is far from insignificant. Side to side tilt of the firearm is one significant source of inaccuracy. This "tilt" is often referred to as "canting" of the firearm. Many hunters and marksmen rely on their inner sense of balance to ensure that the firearm is not canted. This attitude presupposes that the shooter has a fully functional, unimpaired sense of balance and that this sense of balance can somehow be translated over into the handling of the firearm.

Studies of airplane pilots reveal that the human sense of balance is easily confused by a number of influences and that the pilot should disregard his or her feelings and trust the plane's instruments. The human sense of balance is likewise subject to a number of disorienting influences including rifle recoil, the loud sounds associated with shooting, the repeated focusing on distant targets as viewed through one eye, and prolonged periods of standing. A hunter is subjected to even more disorienting influences, including the elements (heat, cold, wind, rain, etc.) and rough and uneven terrain. In addition, hunters may spend hours of hiking through rough and uneven terrain before firing a shot. The human sense of balance can be confused under such circumstances.

Many different kinds of sights have evolved to meet the demands of the market over the past few years with the recent trend being toward higher magnifications. Some scopes approach forty power magnification. Scope builders are challenged to provide a clear and bright image to the eye even at high magnifications. There is more light loss in the scope as magnification increases which results in a dimmer view of the target. Scope makers have made larger objective lenses in order to counter this loss of image brightness. The manufacturers have tended to design larger objective lenses which allow more light into the erector tube, ocular assemblies and, ultimately, the shooter's eye.

While accuracy of such larger scopes has increased, they have created problems. The objective diameter of the scope is so large that the scope must be mounted high off the barrel of the firearm in order to gain clearance between the barrel and the objective housing. At first blush this seems to be only a problem of mounting the scope. The large scope requires taller scope rings in order to mount the centerline of the scope high enough to obtain the necessary clearance. Practically, however, as the scope is mounted higher and higher from the central bore of the firearm, the sighting system becomes more sensitive to inaccuracies due to errors in repeatability. Therefore, various level indicators have been proposed to assist a shooter in maintaining the firearm level and correct one source of shooting error.

The ability of a shooter to maintain his head in an upright shooting position and simultaneously focus on both the aiming indicator and the target greatly affect the ability of the marksman to accurately hit a target. Furthermore, in target shooting, competitions have become so close that anything that detracts from the shooter's accuracy can be extremely detrimental. Windage, perspective, and even atmospheric aberrations must be accounted for by a skilled marksman. Stance, instability, physical fatigue, mental fatigue, eye strain and eye fatigue can adversely affect the marksman. The marksman must even control his breathing. In extremely skilled competitions, competitors are further concerned with the effects of their pulse on the accuracy and precision of their shooting.

To accurately account for all of these variables while still keeping the firearm locked on target, the shooter must be able to "compartmentalize" the variables. That is, he must maintain his primary concentration on the target while unconsciously accounting for the other factors. This is where his training and practice are important. Through training and practice, a marksman can learn to subconsciously adjust his stance, etc., while concentrating on the target. Anything that interferes with the shooter's single primary concentration on the target may be detrimental to his accuracy. Thus, it is most desirable to set up a firearm so the shooter can maintain his primary concentration on the target and shift all other factors to his secondary concentration. That is, the shooter's primary concentration will be a conscious concentration on the target while his secondary concentration will be a subconscious "awareness" of the other factors. In fact, the shooter may not even be consciously aware at all of some of the secondary concentration factors.

For purposes of this disclosure, the term "primary concentration" will refer to the concentration which the shooter is consciously aware of; whereas the term "secondary concentration" will refer to the more or less unconscious state of which the shooter may not even be aware. For example, the target will be a subject of the shooter's primary concentration while the shooter's balance will be a subject of the shooter's secondary concentration.

There have been several prior sighting systems that attempt to provide level indication on firearms in order to help the shooter hold the firearm level during use and to keep the same roll orientation during sighting in and during shooting to help avoid errors due to variables such as those discussed above.

Some of these designs have included bubble levels that are placed in various locations such as on the receiver at the rear of the firearm, or in front of the sight. There are various different mounting schemes such as the use of clamps around a scope body or in front of an iron site and even bubble levels incorporated into the erector assembly inside the scope. All of these designs have been proposed in order to give the shooter an indication of when the firearm is level so repeatable impacts can be made at the target.

The level indicators mentioned above do not approach the above-mentioned division of concentrations and do not recognize that there is a difference between primary and secondary concentrations. Prior level indicators require a shift in visual focus and primary concentration to accomplish objectives other than simply sighting a target, such as leveling the firearm. Thus, these designs are not as successful as possible. As discussed above, in highly competitive shooting the shooter must concentrate on the alignment of the sighting system with the target and on nothing else. Distractions to this concentration such as moving the eye to a bubble level either inside the scope or out of the shooter's field of vision are extremely undesirable and cannot be done simultaneously with sighting the target. As discussed above, these distractions take the shooter's primary concentration away from the target and thus are undesirable.

Some sighting units provide information, such as leveling information, in addition to target sighting assistance. However, since these prior sighting units do not recognize that there is a difference between primary concentration and secondary concentration, these sighting units actually detract from the shooter's primary concentration when providing additional information because this additional information is presented in such a manner as to require the shooter to focus his primary concentration on that additional information. This somewhat vitiates or reduces, the advantages of the additional information. The user of a prior level indicator is required to consciously shift his primary concentration from one information providing element to another during the targeting process. The factors may change during the time it takes to shift primary concentration and the shooter will then be required to again consciously shift his concentration back to the first information providing element. While making these shifts, the shooter must still be subconsciously accounting for the other factors, such as stance, balance and the like.

Psychological studies have shown that a person is able to focus his primary concentration on only one thing at a time. These studies have shown that it can take as much as one full second to fully focus primary concentration on a second item after focusing the primary concentration on a first item. For example, these studies have thus found that cellular telephone use by an automobile driver can be dangerous because the person's primary concentration is not fully focused on his driving, and an accident can occur in the time it takes to shift his concentration from a conversation on the cellular telephone back to his driving. This analogy illustrates the inability of one to actively focus not only one's conscious visual activity but also his concentration on many inputs simultaneously. Therefore, there is a need for a firearm targeting device that can help a shooter accurately aim the firearm without interfering with his primary concentration.

Firearm targeting devices of the past, especially those using a bubble level, generally require the user to align two objects, such as the bubble and reference marks, or the target reticle and the bubble. Aligning two objects in this manner generally requires the user to focus his primary concentration on the objects being aligned. This requires a shift of primary concentration and has the above-discussed disadvantages. For this reason, any level indicator that requires the user to align two elements will require the user to change the focus of his primary concentration, no matter where the level indicating elements are located, thereby creating the above-discussed problems and disadvantages.

Furthermore, in many situations, a firearm does not need to be perfectly level, and sufficient accuracy and precision can be achieved with a firearm that is not as level as in other situations. For example, a tilt of several degrees may be acceptable in one situation, but not in another. Accordingly, it would be desirable to have a firearm level indicator that permits the user to account for leveling tolerances without requiring the user to use his primary concentration to account for the tolerances. Therefore, there is a need for a firearm leveling system that can be utilized while maintaining primary concentration on lining up the sighting system with the target.

While scope type sighting systems have been discussed, it is noted that other sighting systems, such as iron sights, also are subject to the above-discussed leveling problems. Accordingly, the present disclosure is intended to include iron sights as well.

SUMMARY OF THE INVENTION

Various advantages are achieved by a level indicating system of this invention that provides information regarding whether the firearm is level in a manner which is absorbed by the shooter without interfering with his primary concentration on the target. More specifically, a tilt indicator of the present invention provides a shooter with information which he absorbs using his secondary concentration. In this manner, the tilt of the firearm is relegated to the same concentration area as variables such as sway or balance, breathing, etc., and the shooter can therefore maintain his conscious and primary concentration on the target.

The preferred tilt indicator of the present invention includes a visual indicator that is activated when the firearm is level and is not active when the firearm is not level. The indicator is thus binary, that is, it has two conditions, on or off, one of which excludes the other. The tilt indicator can also include other binary visual indicators that are activated when the firearm is not level and are de-activated when the firearm is level. The individual signals of the tilt indicator of the present invention are thus binary, that is, the signals have only two mutually exclusive states as opposed to analog which has an infinite number of states.

Several binary signals can be provided to produce a level indication that changes as the amount of tilt changes. This provides the user with a range of acceptable tilt in which to work whereby if a tilt is acceptable in one situation but not in another, the user can be aware of this and account for it.

One specific embodiment of the level indicating system includes a pendulum-type element having a single pivot access, a weight to keep the pendulum suspended and a series of apertures in the pendulum whereby the pendulum acts as a mask for a set of light emitting/light receiving elements. The pendulum can be damped using magnets or spring-like elements so effects of quick movements of the firearm, including recoil, do not adversely affect the tilt sensor system. Still further, stops can be used to further protect the pendulum from undue movement. One form of the embodiment includes infrared detectors and infrared LED emitters. Each emitter is spaced from its corresponding detector with a plumb line located between them.

The mask blocks light when the mask is located between the emitters and the receivers, and permits light to pass when apertures are located between the light emitters and the light receivers. A circuit interprets which emitter/receiver pairs are blocked and which pairs are coupled. Signals are connected to the circuit to be activated according to which pair is coupled and which pairs are blocked. Firearm tilt is thus interpreted. The intensity of the signal can change according to the degree of tilt, or a flashing signal can have its frequency change as the degree of tilt changes.

The apertures can be teardrop shaped or arranged in order of size so the amount of light passing through an aperture will change according to the position of the aperture with respect to the emitter/receiver pair. The binary signals can thus be used to produce analog-like information.

In addition to the pendulum, other elements can be used, including Hall-effect magnets as well as other similar elements.

Other forms of tilt sensors can be used, including a rolling electrically conductive element, such as a ball. The ball can be used in conjunction with a printed circuit board which defines the exact contacts which are connected by the ball as it rolls along a curved track. One set of contacts indicates level while other contact sets indicate tilted conditions. This is a simple system in which recoil effects are minimized.

In a form of the sensing system which includes coils and an electrically conductive ball that rolls through the coils to alter their impedance, the ball rolls in response to firearm tilt, and the coils are connected to a bridge circuit that sends signals according to the impedance of the coils, and hence in accordance with the degree of firearm tilt. Various elements, such as potentiometers or the like can be included in the bridge circuit to adjust the sensitivity of the circuit. The ball can be located in a tube that is either under vacuum or can contain a fluid to control movement of the ball. The ball rides on a curved track in one form of the invention. Bubbles or the like can be used to act as masks in the case of an optical system.

The ball can also be located on a track defined in the circuit board. When the printed circuit board is cut, it is cut so that traces on either side of the circuit board are opposite to each other. When the ball lines up and connects the circuit board traces on either side of the circuit board and across the edge of the board, the circuit is completed. Plating can also enhance the height and shape of the edge of the traces as they appear at the cut edge of the circuit board. This enhancement makes it easier for the ball to contact both electrical traces. Since the ball is spherical and not flat, there is a slight rise in the edge of the traces in order to ensure a complete circuit when the traces contact across the arc of the ball.

Through electronic circuitry in combination with the ball and track form of sensor, various visual indications can be provided which distinguish the degree of tilt. For example, a first set of traces on either side of the centerline can be indicated as an uninterrupted signal and moving further on traces farther from the centerline can be associated with a cycling signal. The rate of cycle can be used to indicate the degree of tilt.

Other types of electrical circuits can also be used in which the track on which the ball rolls can include a wire wound coil which would make a variable impedance. This system requires calibration so that as the ball moves along a single hot trace and completes the circuit to the opposite side of the track, the circuit converts the impedance into a signal.

The invention can alternatively include LED indicators which are accessed with the ends of fiber optic cables. Several cables can be used, with one cable, such as a central cable, indicating a level orientation for the firearm while other cables indicate tilted conditions. The fiber optic cables are brought from the level indicator LEDs to an optical interface in front of a sighting system. The sighting system can include a rubber annular ring which surrounds the ocular lens of a scope, or an iron sight or other such target sighting element used on a firearm. The sighting system can include several, such as three, small holes connected to the fiber optic cables. The rubber ring can be incorporated into the sighting system eyepiece which a user uses to block extraneous light from entering his field of vision. Alternatively, the level indicator system can provide an output for wires and a single electrical cable can be brought up to the sighting system. Separate indicators, such as incandescent lamps or LEDs or the like, can be placed remotely at the sighting interface in a manner similar to that described above.

Such separate indicators may reflect orientation as measured by an accelerometer. In such an embodiment, a controller may initiate activation of a particular signal indicator in response to the accelerometer sensing an angular orientation or a specified range of angular orientation. As such, the controller generates and conveys a signal indicative of firearm tilt to the indicator in such a manner as to not obstruct visual acquisition of the image.

The level indicating system of the present invention can be used in connection with any firearm and sighting system combination. The signal indicators are housed in the eyepiece and can be placed on any sighting system eyepiece.

BRIEF DESCRIPTION OF THE DRAWINGS FIGURES

DETAILED DESCRIPTION OF THE PREFERRED EMBODIMENT OF THE INVENTION

For initial discussion purposes, it is helpful to illustrate basic shooting difficulties addressed by the invention. The firearm must be held in exactly the same position for each shot or errors are magnified, especially by taller scopes. This sensitivity is acutely important when considering the uprightness with which the firearm is held. This is commonly called holding the firearm level. That is, the firearm is held so the sighting of the target is carried out with the firearm in exactly the same vertical plane as it was when the firearm was sighted in. Rolling the firearm about its central axis with respect to the orientation of the firearm when it is initially sighted in will have detrimental effects on the accuracy of the shot. This will be referred to herein as being out of level and the roll will also be referred to as cant or tilt. This is a common problem that has been addressed in many ways, none of which solve the problems inherent in the human psyche.

There are two compounding problems. The first problem is that when sighting through a scope or iron sight, the eye sees the target through the central axis of the sighting system which may be offset from the bore central axis of the firearm. The second problem is that the actual bore or central axis of the barrel is at an angle to the central axis of the scope. In essence, there are two converging lines, the central axis (sight line) of the scope and the central axis (bore) of the barrel. In theory, if the projectile had no trajectory, the point of impact would be where those two lines intersect. However, since a projectile always drops from the moment it leaves the muzzle, compensation must be made in order to enable the projectile to accurately hit the intended target.

Determination of the necessary compensation for a given target range is termed as "sighting in" a firearm or a scope so impact of the projectile will match the optical center of the target at a given distance. For example, if a firearm is sighted in with a 100 yard zero, the impact point of the projectile will be where the optical system is centered at 100 yards. If shooting is at a target 50 yards out, normally the shooter compensates for elevation (trajectory) in estimating where the projectile will impact a 50 yard target based on a 100 yard zero point. In such a case, if the scope is rotated about the scope's central axis (i.e., out of level) not only will the point of impact be elevationally incorrect, but will also be windage incorrect due to the error between the point of impact and the closer or farther away target.

Figure 1:
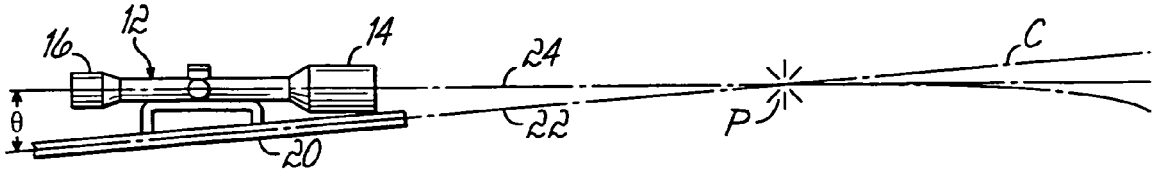
FIG. 1 is a schematic illustrating a sight line through a scope in relation to a trajectory of a projectile from a firearm.
Figure 2:
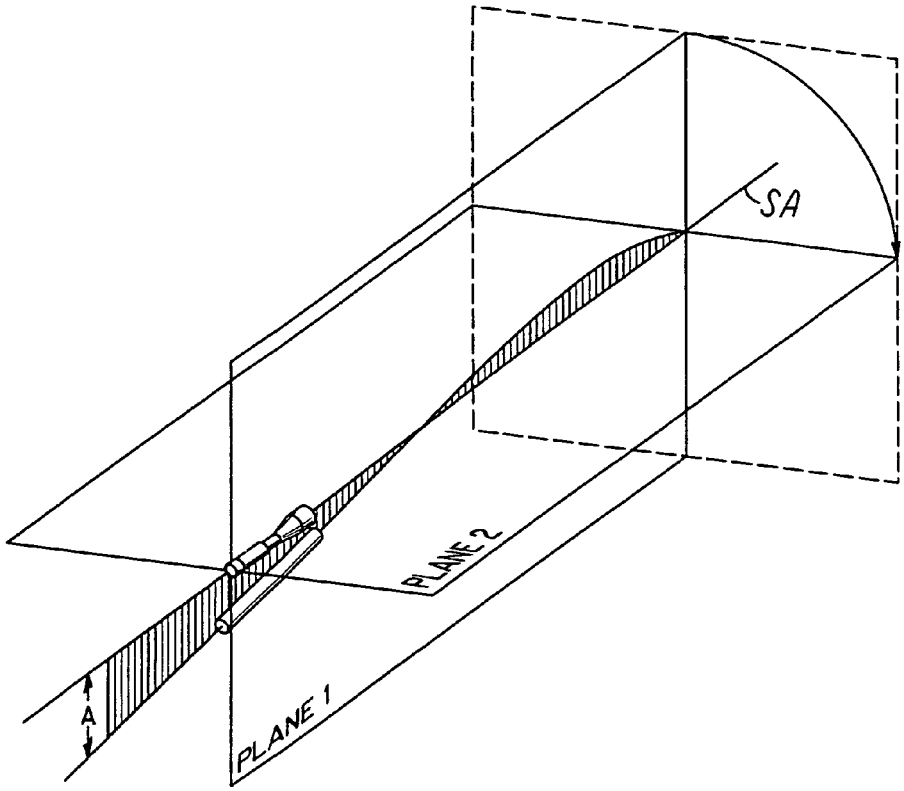
FIGS. 2 and 3 are schematics illustrating how cant affects a projectile between the time it leaves the firearm and impact.
Figure 3:
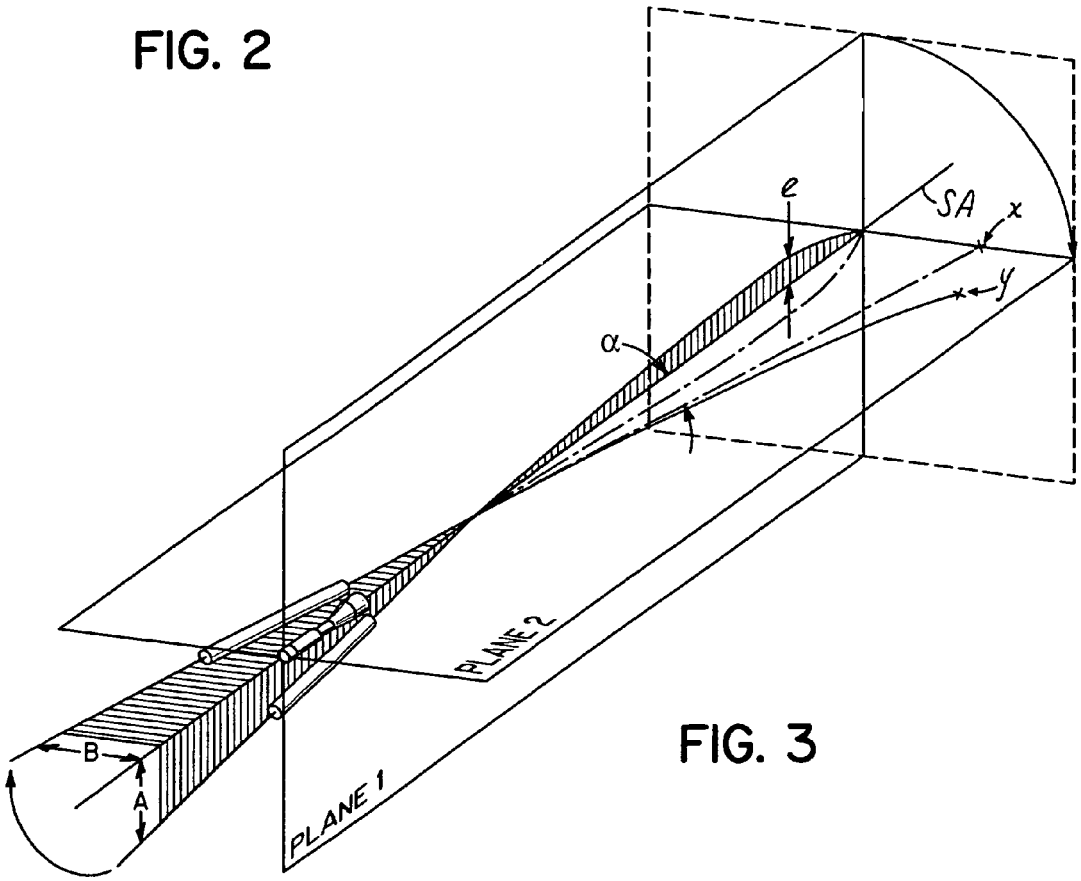

This effect can be understood from the following discussion with reference to FIGS. 1-3.

As shown in FIG. 1, sights on a firearm are placed at an angle to the bore to make up for the forces that act on the projectile during flight. The most important of these are gravity and air movement or wind. Gravity acts in the vertical direction and its effect is proportional to time of flight. As a result, the sight is adjusted as indicated in FIG. 1. FIGS. 2 and 3 show a graphic depiction of a typical projectile trajectory showing a sight axis SA versus the bore axis of a standard trajectory (exaggerated for clarity) for an air gun (see plane 1). The projectile path trajectory is shaded to show the area under and above the central site axis. Because the shooter's eye is the point of reference when a firearm is canted, the sighting axis SA becomes the axis of rotation. This in turn rotates the barrel directly under the sighting axis. Therefore, the illustrations show the sighting axis always as the center of rotation. Cant may happen in either a clockwise or a counter-clockwise direction about a point.

Plane 2 shows a firearm which is canted 90 degrees counter-clockwise. The angle between the bore and the sight line is indicated as angle A. Since the relationship between the scope and the barrel does not change when the firearm is canted, an identical plane is shown rotated counter-clockwise 90 degrees. Although it would be hard to cant a rifle 90 degrees, it is shown this way to allow the illustrations to be clear. The second plane still maintains the central sight axis SA at the target, however, the projectile has been directed to the left.

The trajectory path shown in Plane 2 is imaginary, a result of gravity from Plane 1 sighting settings. The gravity that once pulled the projectile back onto the target still pulls down on the projectile; however, some of the elevation offset "e" is lost. This accounts for the elevation error or in effect the "drop" in projectile impact. In addition, the elevation angle A that was used in the Plane 1 to counteract gravity has now become a windage angle B directing the barrel off to the left.

Therefore, two errors have been introduced: the first error being that of the barrel pointing off to the left and the second error of no longer having gravity normal to the elevation plane. These two errors combine to cause a projectile to hit low and to the right of a target when the firearm is canted or rolled about its central axis from the sighting in orientation. The new projectile path is shown to hit at a point of impact "y". This actual point of impact "y" therefore accounts for both windage and gravity effects.

Therefore, when a marksman needs to accurately hit a target, it is highly desirable to have a telescopically equipped firearm that is kept perfectly and repeatably level during sighting in and during all shooting.

Figure 4A:
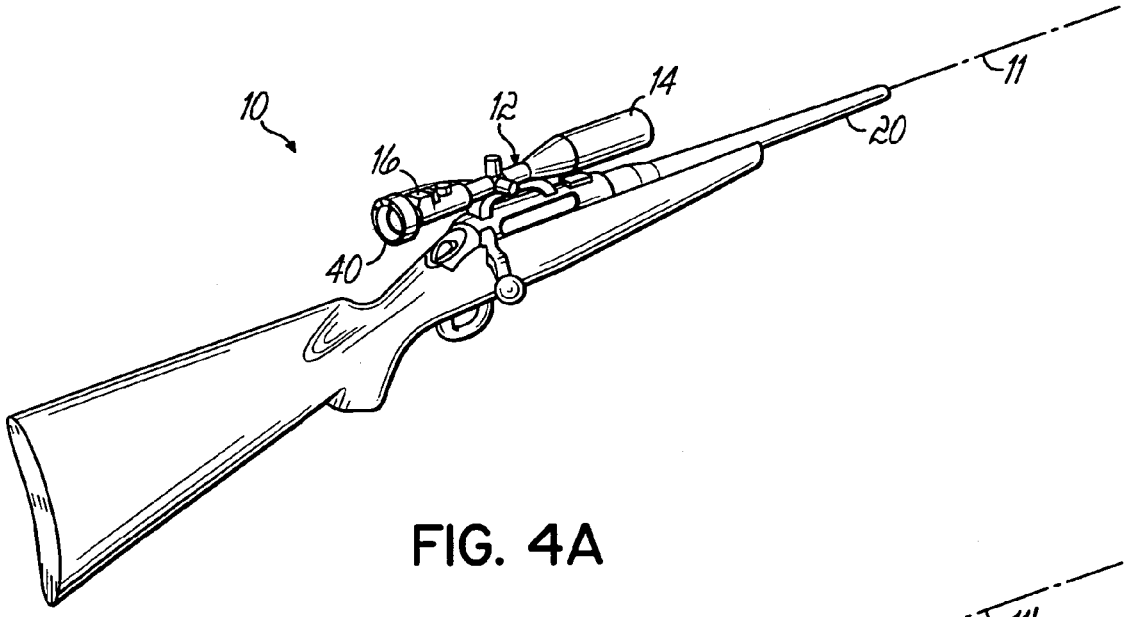
FIG. 4A is a rear and top perspective view of a scope mounted on a firearm.
Figure 6A:
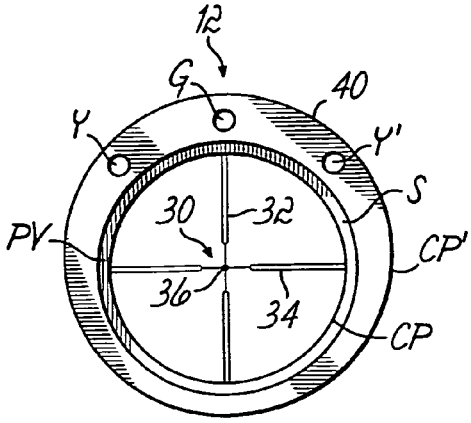
FIG. 6A illustrates a telescopic sight.

Shown in FIG. 4A is a firearm 10 having a central axis 11 and having a scope 12 mounted thereon. Scope 12 has an objective section 14 on one end thereof and an ocular section 16 on another end thereof. As discussed above, and indicated in FIG. 1, scope 12 is mounted at an angle Θ to bore centerline C in order to compensate for the effect of gravity on a projectile fired from bore 20 of firearm 10. The trajectory 22 of the projectile is indicated in FIG. 1 and sight line 24 from scope 12 is also shown. Since scope 12 is mounted at an angle with respect to trajectory 22, sight line 24 will intersect trajectory at point P. As discussed above, point P is set when the firearm is sighted in. As shown in FIG. 6A, scope 12 includes a targeting reticle 30 which includes a vertical crosshair 32 and a horizontal crosshair 34 which intersect at intersection 36 which can correspond the point P of impact in FIG. 1 for a sighted in distance.

Figure 4B:
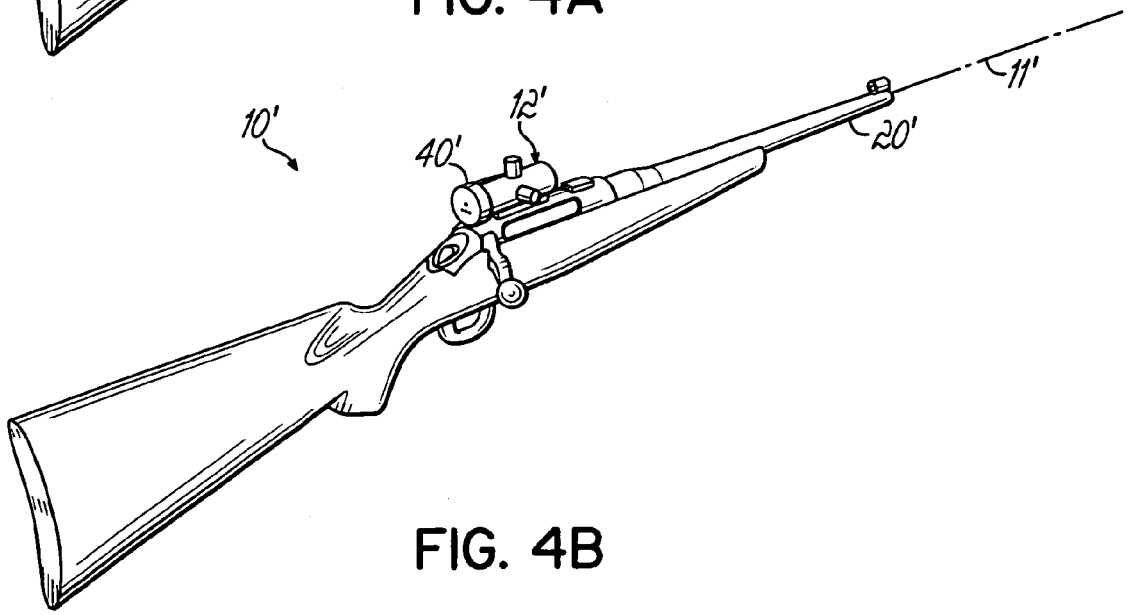
FIG. 4B is a rear and top perspective view of an iron sight mounted on a firearm.

Shown in FIG. 4B is a firearm 10' which includes an iron sight 12'. Iron sighted firearm 10' is subject to the above-discussed sighting-in and leveling problems. Accordingly, firearm 10' will not be discussed in detail as the description presented will be applicable to this firearm as well.

In using scope 12, a marksman concentrates his primary concentration on placing his target in the proper position on reticle 30 to accurately hit the target. The marksman is consciously concentrating on this placement while unconsciously accounting for his body sway, tilt, and other such factors in his secondary concentration. As discussed above, it is most desirable that the marksman be able to maintain his primary concentration on targeting while relegating the other elements to his secondary concentration. As was also discussed above, tilt of the firearm is a factor in accurately hitting a target. That is, if the firearm is rolled about its central axis 11 from its orientation during initial sighting in, the precision of the firearm and its targeting system will be affected and hence the accuracy of the shot will be affected. Heretofore, firearm tilt indicators have required the shooter to focus his primary concentration on them, thereby taking his primary focus off of the central task of aligning the target with the sighting device. As discussed above, this vitiates the effectiveness of the entire firearm targeting system.

Figure 6B:
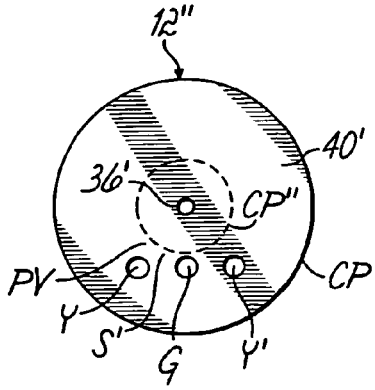
FIG. 6B illustrates a peep sight.

A peep sight 12", such as shown in FIG. 6B, is used in conjunction with firearm 10'. In using sight 12", a marksman focuses his primary concentration on placing his target in proper position in peep aperture 36'. The primary concentration will be focused on targeting, while the other elements should be placed in the secondary concentration. As discussed above, it is the primary object of the present invention to place firearm level and/or tilt information into the secondary concentration of the marksman.

The present invention positions the firearm tilt indicating system so information from this tilt indicating system is absorbed by the shooter via his secondary concentration so his primary concentration on the target is uninterrupted.

Figure 5:
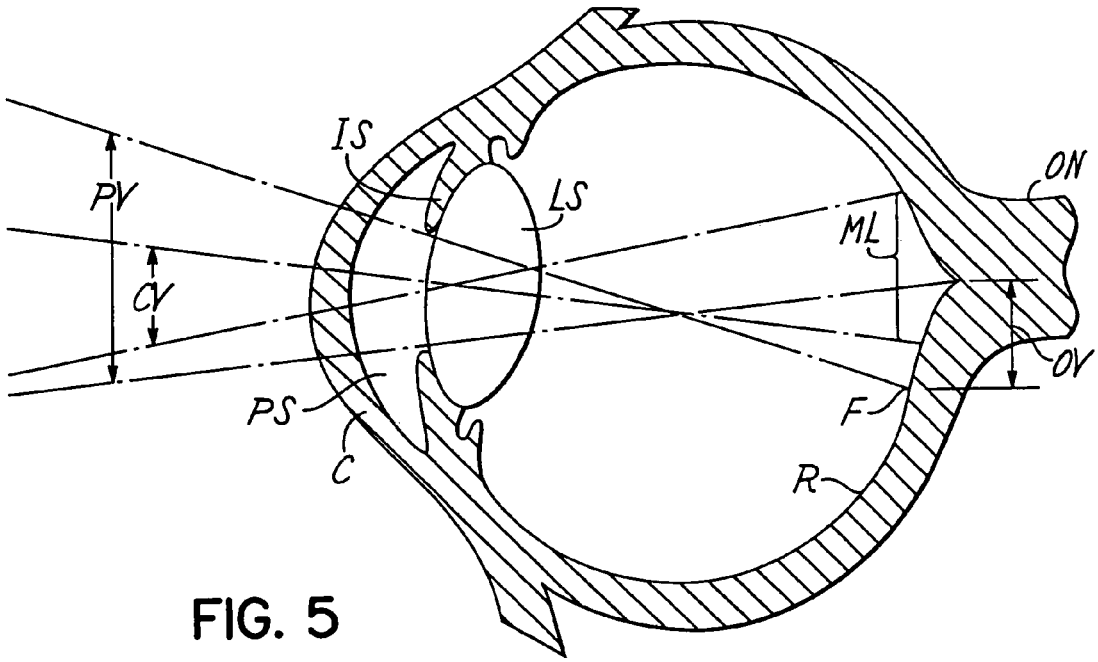
FIGS. 5 and 5A are sectional views of an eye with the macula lutea indicated and an indication of both the central vision and the peripheral vision associated with the eye.

Referring to FIG. 5, it can be seen that a person's eye has a portion ML known as the macula lutea. The macula lutea is defined in references such as Taber's Cyclopedic Medical Dictionary edited by Clarence W. Taber and published in 1963 by F. A. Davis Company of Philadelphia as "the yellow spot on the retina about 2.08 mm to the outer side of the optic nerve exit . . . which functions as the area of most acute vision (central vision)," and peripheral vision is defined by the McGraw-Hill Dictionary of Scientific and Technical Terms edited by Daniel N. Lapedes and published by McGraw-Hill Book Company in 1974 as "the act of seeing images that fall upon parts of the retina outside the macula lutea. Also known as indirect vision." The area of a person's central vision is indicated in FIG. 5 as CV and the area of a person's peripheral vision is indicated in FIG. 5 at PV. The peripheral vision area extends to the outer limit of the perimeter subtended by a cone OV which represents the total field of vision for an eye without moving the eye from a focal point. The area of central vision is defined by drawing lines from the outside of the macula lutea, which is located around the optic nerve with a radius of 2.08 mm, through the eye lens. The cone thus defined will be the area on which the person's central vision is focused; whereas, the area outside of such cone, but still within the area defined by the intersection of cone OV and retina R, will be the area of the person's peripheral vision. The central vision cone will thus have a planar "base" area at a particular location defined by the radius of the cone at that location. The limits of the central vision and the peripheral vision will be more specifically discussed below with regard to FIG. 5A. For the sake of reference, as shown in FIG. 5, the eye includes optic nerve ON, lens LS, iris IS and pupil PS. As shown in FIG. 5, the focal point F is outside the macula luta and just at the perimeter of cone OV so the focal point will be seen, but in peripheral vision and very fuzzy.

Figure 5A:
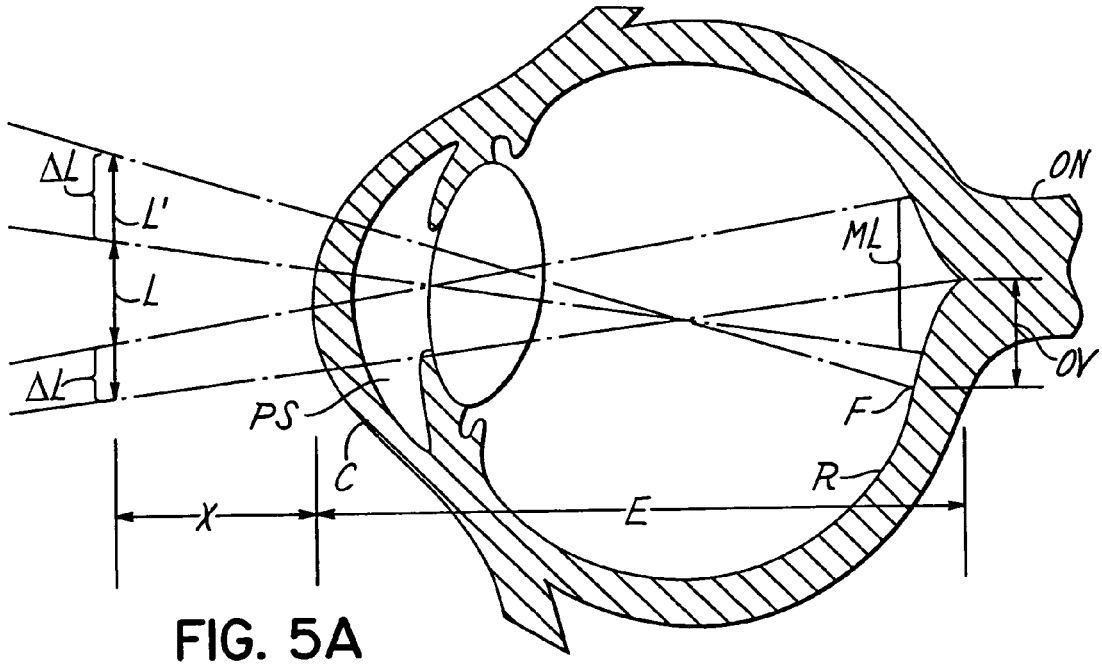

Referring to FIG. 5A, it can be seen that dimension L represents the linear dimension of the area that will be viewed by a viewer's central vision at a distance X from the viewer's eye since the limits of dimension L fall on the limits of the macula lutea of the viewer's eye; whereas dimension L' represents the linear dimension of the area that will be within the outer limits of sight at distance X from the user's eye because the limits of dimension L' fall on the area defined by cone OV without moving the viewer's eye. Accordingly, dimension ΔL represents linear dimension of the area that will be viewed by the viewer's peripheral vision when that viewer is focusing on object L at distance X from the eye. Thus, any object in the annular area having a dimension ΔL and extending from the limits of dimension L to the limits of dimension L' will be viewed by the viewer's secondary concentration while his primary concentration is on objects in the area represented by dimension L. By geometric construction, it can be concluded that $L=M_L$ (X/E) where $M_L$ is the diameter of the macula lutea; X is the distance between the plane containing cornea C of the viewer's eye and the plane containing the object being viewed; and E is the distance between the plane containing the viewer's retina and the plane containing the cornea of the viewer's eye. Further, $L'=O_v$ (X/E) where $O_v$ is the linear distance defined by the intersection of cone OV and the viewer's retina and is the outer limit of the area that can be viewed by a viewer's peripheral vision without moving his eye from a given position. Thus, in accordance with the teaching of the present invention, the tilt signals are located in annular area represented by dimension ΔL which is outside the circle having a diameter L (the area of primary concentration) and inside a circle having a diameter L' (the area of secondary concentration).

People naturally focus their primary concentration on the items in their central vision and relegate items in their peripheral vision to their secondary concentration. Accordingly, the tilt indicator of the present invention has its signal output located to be in the peripheral vision of the shooter while he focuses his central vision on the target. Therefore, referring to FIG. 6A, tilt or level indicating signal 40 of the present invention is located on the firearm target viewing element to be outside the area CV when area CV is focused on reticle 30 (with area CV having a dimension L as discussed above), and hence in area ΔL. Target reticle 30 includes intersection 36 at or near which the shooter will place the target. Thus, his central vision will extend to an outer periphery indicated by circle CP which represents the intersection of the central vision cone with the plane containing the reticle 30 (with dimension L). All items located outside perimeter CP (but within perimeter CP' which corresponds to dimension L' discussed above) will be viewed by the shooter's peripheral vision, with perimeter CP being sized by the above-discussed construction from the outer periphery of the macula lutea via the central area of the lens of the eye. Accordingly, firearm level indicating signal 40 of the present invention is located beyond the area circumscribed by perimeter CP but within perimeter CP' and hence in position to be viewed by the user's secondary concentration.

In other words, if the area containing the level indicator signal is $Area_{pv}$ (i.e., the area corresponding to the peripheral vision of the shooter when he is focusing on the target), and the area contained in the central vision cone is $Area_{cp}$ (which is equal to $Area_{cp}$), the area circumscribed by the intersection of the central vision cone and the plane containing the reticle, then $Area_{pv}$ surrounds $Area_{cp}$ (i.e., the peripheral vision area surrounds the central vision area). As shown in FIGS. 6A and 6B, there is a space S and S' between perimeter line CP and CP' (which corresponds to the annular area having a linear dimension ΔL discussed above) and the location of the firearm level indicator signal to ensure that the signal is viewed by the user's peripheral vision and to ensure that the information associated with the level indicator signal does not interfere with the shooter's primary concentration.

Referring to FIG. 6B, tilt or level indicating signal 40' is located on firearm target viewing element 12" to be outside area CP" when area CP" (representing the central vision) is focused on peephole 36'. As shown in this illustrative example, target viewing element 12" is on an iron sight equipped firearm as, for example, shown in FIG. 4B. The marksman's central vision extends to an outer periphery on element 12" indicated by circle CP" which represents the intersection of the central vision cone with the peepsight 12". All items located outside perimeter CP" (but within the above-discussed outer vision cone represented in FIG. 6B as perimeter CP"') will be viewed by the marksman's peripheral vision, with perimeter CP" being sized by the above-discussed construction from the outer periphery of the macula lutea via the center of the lens of the eye. Signals from level indicator 40' are located outside the area circumscribed by the central vision circle CP" and hence will be in position to be viewed by the user's secondary concentration while the viewer's primary concentration on the target via the targeting display is uninterrupted and non-distracted by the firearm level indicating system.

The level indicating system of the present invention can take several forms, just so the signal thereof is located to be outside the area of the shooter's primary concentration and in the area which is viewed by the shooter's secondary concentration when he is focusing his primary concentration on the target with no shifting back and forth between primary objects and other signals.

Figure 7:
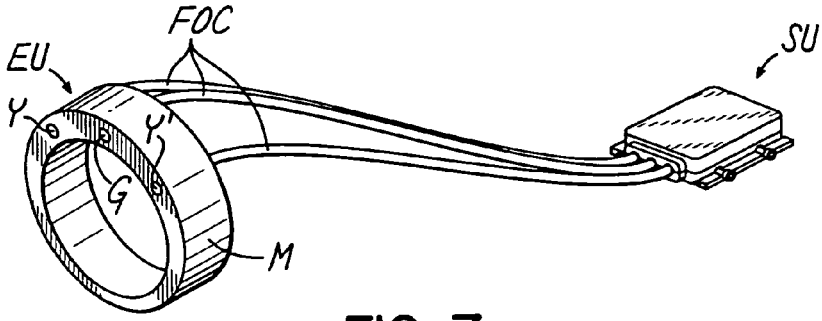
FIG. 7 is a perspective view of an overall unit incorporating the present invention.
Figure 8A:
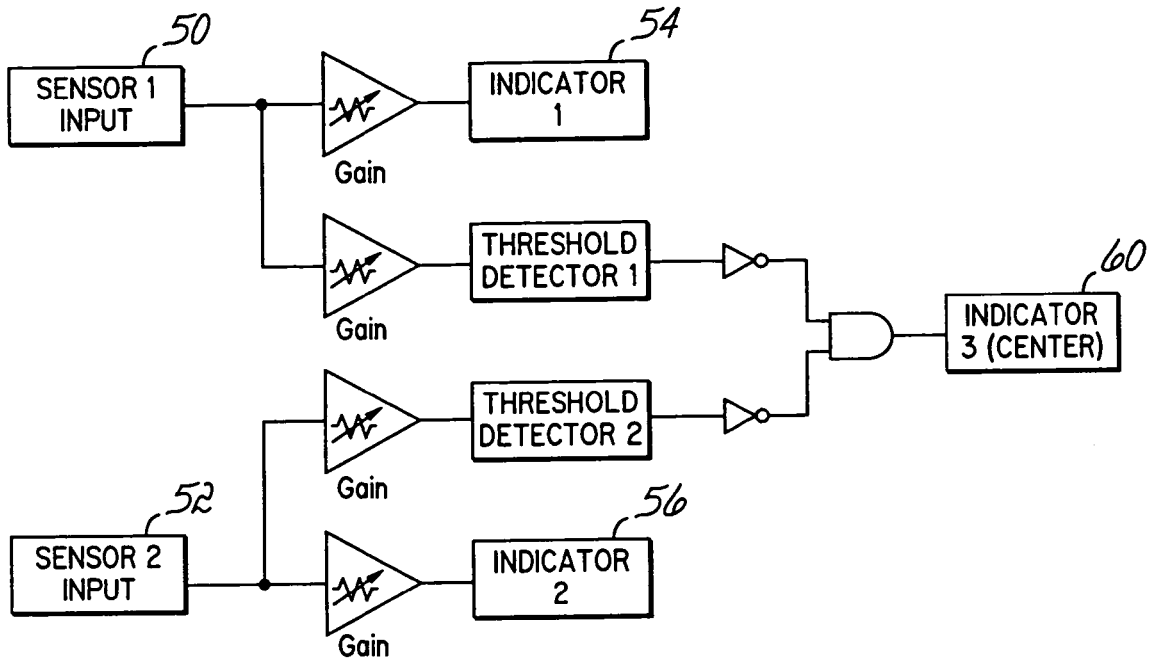
FIG. 8A is a schematic of a bridge circuit used in connection with the sensor and signal elements of the firearm tilt indicator of the present invention.

The overall system used for the level indicating system is shown in FIG. 7 and a basic circuit is indicated in FIG. 8A. As shown in FIG. 7, the system includes a sensor unit SU which is mounted on a firearm for movement therewith, cables, such as fiber optic cables FOC connected at one end thereof to light sources in unit SU and at the other end to indicators Y, Y' and G mounted in a mount M that is attached to eyepiece EU of a sighting system. Indicators Y, Y' and G will be discussed below and indicate the tilt of the firearm as sensed by sensors in unit SU and as interpreted by circuitry associated with the sensors in unit SU.

FIG. 8A is a block diagram which shows two sensor inputs 50 and 52 driving indicators 54 and 56 respectively and logic circuitry 58 required to have a third indicator 60 show "on" when the indicators 54 and 56 are "off". Indicators 54 and 56 are driven by the input from sensors 50 and 52 respectively. The sensor signals are conditioned appropriately (shown in the block diagram as adjustable gain, though the conditioning could result from a fixed design) in order to drive the indicators. These indicators can respond to the conditioned sensor signal with increasing brightness as the sensor signal increases, changing in a flashing rate as the signals increases, or the like as appropriate for the user.

The sensor signals are also conditioned appropriately to drive logic circuit 58 shown as including Schmitt trigger input inverters, to form a logical NAND so that if both sensors 50 and 52 signals are below the logic threshold (from the Schmitt trigger inverters), then indicator 60 is "on." Any other condition results in indicator 60 being off.

Inductance Circuits

The sensor inputs can be realized from a plurality of technologies. For example, as will be discussed below, the level indicator could be constructed so that a ball rolls in and out of inductive coils. The ball is of a material that substantially changes the inductance of the coils. Such "slug-tuned" indicators, commonly found in radio frequency circuits, are well known though the adjustment method is quite different. The coils are located at either end of the level so the ball can roll thereby exhibiting the largest change in inductance. The cores are chosen for their properties of reluctance and frequency response. Additionally, "air core" inductors are widely used though their inductance per volume is much lower than coils with a ferromagnetic core. The slug tuned coils are attractive since the "free space" does not, for practical purposes, magnetically saturate or suffer from the frequency response limitations of core materials.

If a leveling tube has coils wrapped around the outside of a leveling element, the inductance of the coils will be largely unaffected by glass, plastic, dampening fluid or other materials of the tube. Allowing a ball made of steel or other ferromagnetic material to roll constrained within this leveling tube would change the inductance of the coils as it moves in and out.

Figure 8B:
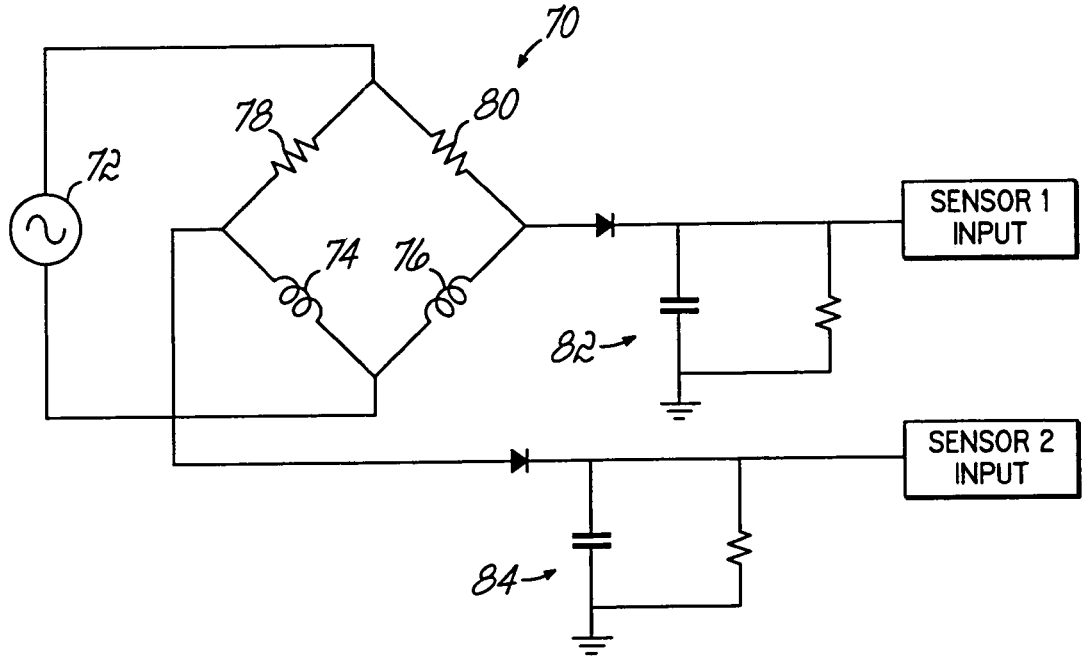
FIG. 8B is a schematic of a bridge circuit used in connection with coils and a "slug tuned" circuit.

One method of sensing the change in inductance is shown in FIG. 8B and includes a balanced bridge 70. Bridge 70 is driven with an a-c source 72 at an appropriate frequency so the changes in inductance are optimally detectable. The change in inductance from coil 74 or coil 76 is sensed as the bridge is unbalanced due to one or the other inductors changing impedance as the ball or slug is introduced into the center. Resistors 78 and 80 serve to construct the bridge and are also adjusted to account for differences in the coils. The resistor values are selected to balance power consumption and detection of inductance changes.

The voltage detectors and filters 82 and 84 shown in FIG. 8 can utilize nearly any RF detection technique, including simple diode and filter circuits well known as envelope detectors. The values of the capacitors and resistors are chosen to balance the needs of power consumption, rate of change for the user interface and other considerations known to those skilled in the art based on the teaching of this disclosure.

Optical

Figure 9:
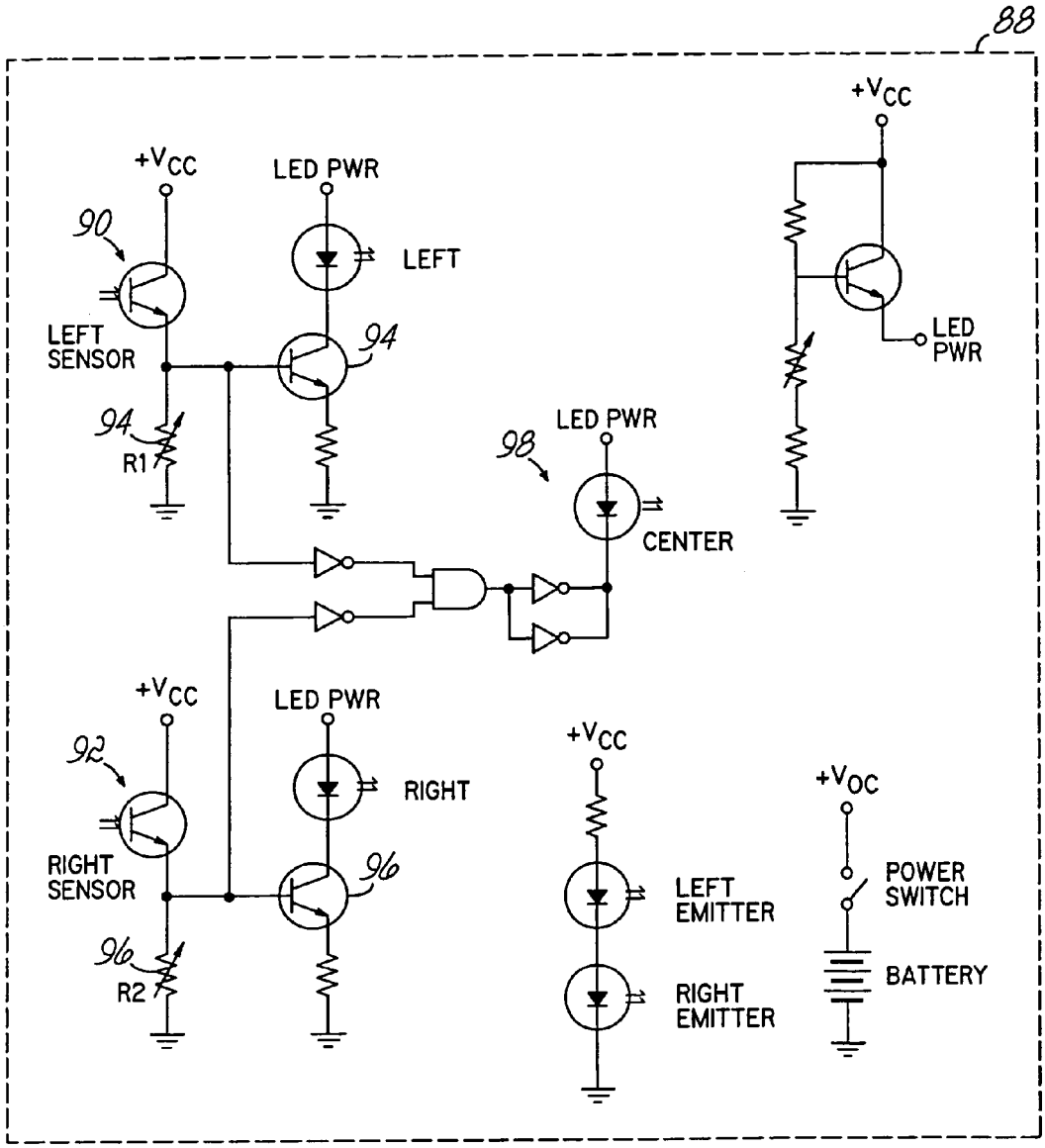
FIG. 9 is a schematic of an optical circuit used in connection with the sensor and signal elements of the firearm tilt indicator of the present invention.

Alternatively, a specific embodiment of an optical approach is shown in FIG. 9. FIG. 9 shows all electrical elements of a circuit 88. Left and right sensors 90 and 92 have their sensitivities adjusted by resistors 94 and 96 respectively. With properly chosen emitter resistors for the LEDs, a balance of the indicator threshold and logic threshold can be obtained. This will allow the left and right LEDs 94 and 96 respectively to begin to come on while the center LED 98 is still lit. This design has an "off/on" condition for center LED 98 while left and right LEDs 90 and 92 have variable brightness depending on the degree of tilt.

A calibration approach for this design includes blocking the left sensor and adjusting RF so left LED just starts to fade, then returning the adjustment so that the LED is on fully. The design allows for the voltage at "A" to go below the digital threshold when the left LED is nearly on fully (as sensed by the emitter resistor).

Figure 10:
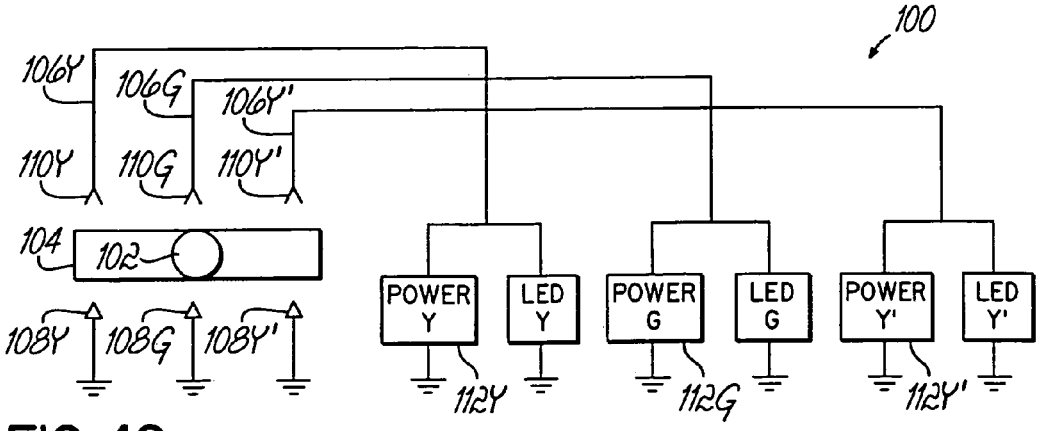
FIG. 10 is a schematic of a simple switch-type circuit used in connection with the sensor and signal elements of the firearm tilt indicator of the present invention.

Yet another approach to translating firearm tilt into signals includes a circuit such as circuit 100 shown in FIG. 10 in which a ball 102 rolls in a cylinder 104 mounted on the firearm. Ball 102 rolls left or right according to the tilt of the firearm. Light activated circuits 106Y, 106G and 106Y' are each arranged to provide a circuit between an emitter 108Y, 108G and 108Y' and a receiver 110Y, 110G and 110Y' respectively when light from the emitter is received by its corresponding receiver. Ball 102 is opaque and thus prevents light from reaching a receiver when the ball is interposed between the emitter and the corresponding receiver. Circuit 100 is arranged whereby power from source 112Y is short circuited and hence not applied to LED Y' when light from emitter 108Y is received by receiver 100Y and so forth. However, when ball 102 is interposed between an emitter and its corresponding receiver, the circuit is open at that point whereby current flows to the LED. Thus, as shown in FIG. 10, with ball 102 interposed between emitter 108G and receiver 106G, lights Y and Y' are dark as their power sources are shorted, but light G is active as its power source applies power to LED G. Thus, the circuit 100 is really a simple switch circuit.

Figure 11A:
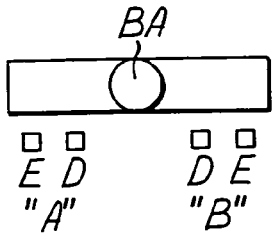
FIG. 11A is a sketch illustrating the use of a ball or bubble used in connection with optical sensors to indicate the tilt of a firearm.

The position of a ball BA or bubble in the level sensor of the present invention can also be determined by optical sensors "A" and "B" as indicated in FIG. 11A. More specifically, the reflectance of the ball or bubble can be sensed by emitter and detector pairs that measure and respond to reflected light from the bubble or ball as indicated in FIG. 11A.

Figure 11B:
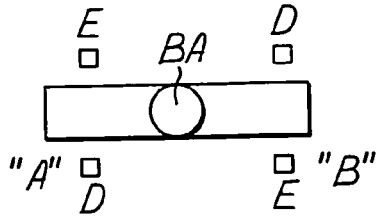
FIG. 11B is a sketch illustrating another form for the use of a ball or bubble used in connection with optical sensors to indicate the tilt of a firearm.

Another system is shown in FIG. 11B and allows the bubble or ball to obstruct the light in communication between an emitter and detector pair. The emitter and detector pairs can be arranged advantageously to avoid interference or "cross talk" between them. In either system shown in FIGS. 11A and 11B, determining the position of the ball or bubble can be accomplished by detecting its presence in a given region. Rather than placing an emitter-detector pair in the "middle" to detect level, the circuit shown in FIG. 13 shows a lack of presence yielding information.

Figure 13:
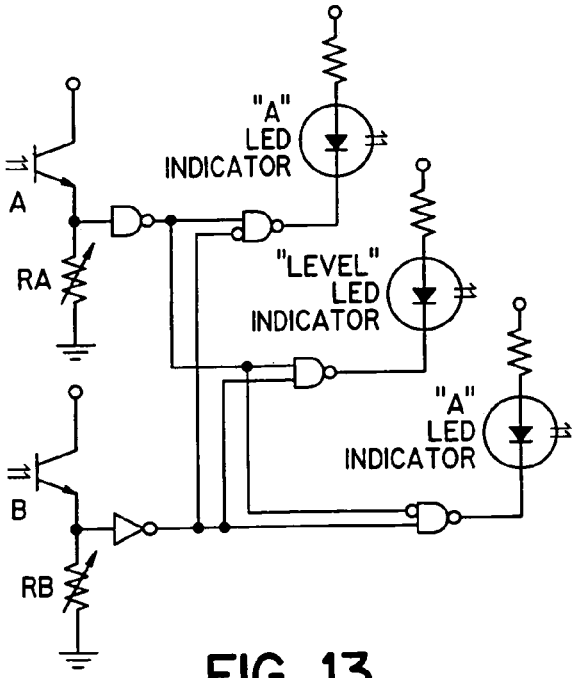
FIG. 13 is a schematic of a circuit using optical output to activate signals concerning the tilt of a firearm.

The schematic shown in FIG. 13 illustrates an embodiment that uses light emitting diodes as the emitters and phototransistors as the detectors. Power is supplied to the emitters and is regulated as shown to allow operation within the recommendations of the manufacturer. The optical signal is received by photoresistors connected so that the low impedance emitter node drives the circuit. The variable resistors RA and RB are shown as one way to calibrate the circuit. Appropriate values for these variable resistors can be chosen to account for the fixed and variable optical properties of the level tube materials and the variations of the current transfer ratio of the emitter-detector pair. This allows calibration.

The output of the photoresistors is received by a Schmitt trigger input digital device to allow for noise margin. The logic that follows lights the "A" indicator when the ball or bubble is within the "A" region. It also lights the "B" indicator when the ball is within the "B" region. An illustrative feature of this logic lights the "level" indicator when the ball or bubble is not detected within either the "A" or the "B" region. This schematic can be expanded for any number of emitter-detector pairs and combinations. The logic can be expanded to accommodate the required functions.

Figure 14:
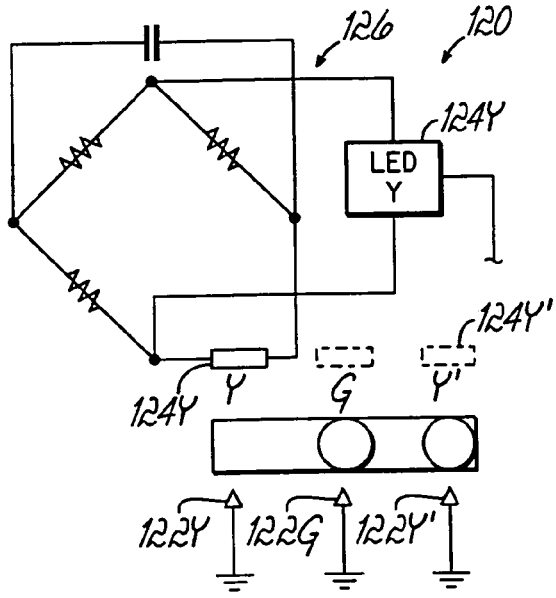
FIG. 14 is a schematic of a simple circuit which uses bridge circuits in conjunction with each light receiver element and which is used in connection with the sensor and signal elements of the firearm tilt indicator of the present invention.

Shown in FIG. 14 is yet another circuit 120 which is a resistance sensor and which uses a change in resistance of a light sensitive element to directly unbalance a resistance bridge to change the intensity of a signal element. For example, as shown in FIG. 14, when light from emitter 122Y falls on receiver 124Y, the resistance of a resistor associated with receiver 124Y changes unbalancing bridge circuit 126 and changing the intensity of LED signal 128Y. Similar bridge circuits are associated with signals G and Y'. A ball 102' located in chamber 104' mounted on the firearm rolls to affect the light transmitted and received by the receivers 124Y, 124G and 124Y'.

Resistance

Figure 12A:
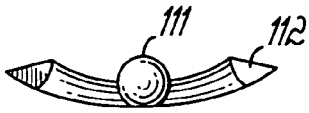
FIG. 12A is a sketch of a ball and track arrangement for a coil/ball form of the system used to sense firearm tilt.
Figure 12B:
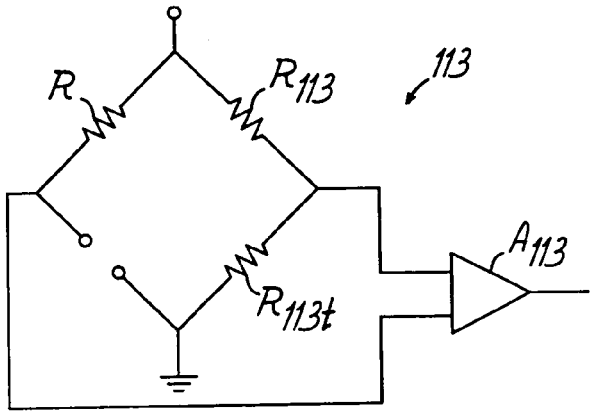
FIG. 12B is a schematic of a resistance bridge circuit used in connection with the sensor and signal elements of the firearm tilt indicator of the present invention.

Changing values of resistance can also be used to determine the amount of tilt of a firearm. Systems incorporating resistance in this manner are shown in FIGS. 12A and 12B. Referring to FIGS. 12A and 12B, it is seen that the position of a ball 111 on a track 112 can be sensed by measuring the value of resistance of the electrical path formed by the ball and the track. Measuring the resistance can be done using a bridge circuit such as bridge circuit 113. Determining the position of ball 111 on track 112 is made by knowing the relationship of resistance to position of ball 111 on track 112. Bridge circuit 113 has a voltage that is proportional to the resistance of the track. The values of $R_{113}$ and $R_{113t}$ are chosen to accommodate the requirements of precision, power consumptions, and other practical trade-offs normally encountered in circuit design.

Calibration of "level" can be obtained in several ways. One way is to mechanically level the system and then establish that resistance as "level". Then values of resistance less than "level" would indicate out of level in the other direction. Another way is to mechanically level the system then adjust $R_{113}$ and the gain of the associated amplifier $A_{113}$ to accommodate comparisons of position, displays or other indicators.

Various elements can be used to control the amount of light received by a receiver based on the tilt of the firearm. Several examples of such elements are disclosed in FIGS. 15 through 18. However, these embodiments are intended to be examples only and are not intended to be limiting, as other forms of such elements will occur to those skilled in the art based on the teaching of this disclosure. These elements are also intended to be included within the scope of this invention as well.

Masks

Figure 15:
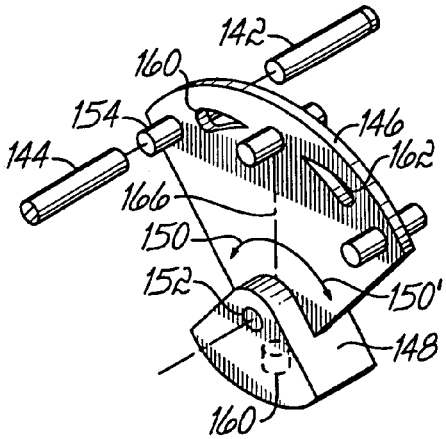
FIG. 15 is a perspective view of a mask used to control an optical sensor form of the tilt sensor of the present invention.
Figure 16:
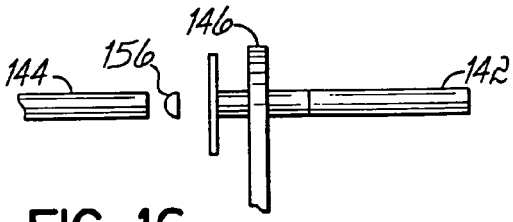
FIG. 16 is a top plan view of the sensor shown in FIG. 15.

Shown in FIGS. 15 and 16 is a system 140 which includes two light emitter elements, such as element 142 which can be an incandescent light source if suitable, and two light receiving elements such as element 144 which can correspond to elements 90 and 92 shown in FIG. 9 for circuit 88. Light transmission to receiver 144 is controlled by mask element 146 which is pivotally mounted on base 148 to swing in directions 150 and 150' about pivot pin 152. Base 148 is fixed to the firearm and oriented so mask 146 pivots in directions 150 and 150' as the firearm is tilted about its longitudinal axis as discussed above. A magnet 160 is located in base 148 and mask 146 is metallic so pivotal movement of mask 146 is damped by magnet 160. This prevents undesired movement of mask 146 or undesired impact between mask 146 and stops associated with projections 154 and 154' if the firearm is tilted too rapidly or too much. A lens, such as lens 156, focuses light onto each light receiving element.

Mask 146 includes teardrop shaped holes 160 and 162 through which light passes when the holes are aligned with the light emitters. The teardrop shape of holes 160 and 162 causes light amounts to increase or decrease according to the position of the hole with respect to the light source. In this manner, the light intensity associated with the signals, such as signals 94 and 96 in FIG. 9, will vary according to the amount of firearm tilt. As discussed above in regard to circuit 88, when mask 146 is in an upright orientation, that is when vertical centerline 166 is vertical with respect to the ground, no light will pass mask 146 and center signal 98 will be activated. The same condition can be effected using circuit 100 or circuit 120 with mask 146 substituted for ball 102.

Figure 17:
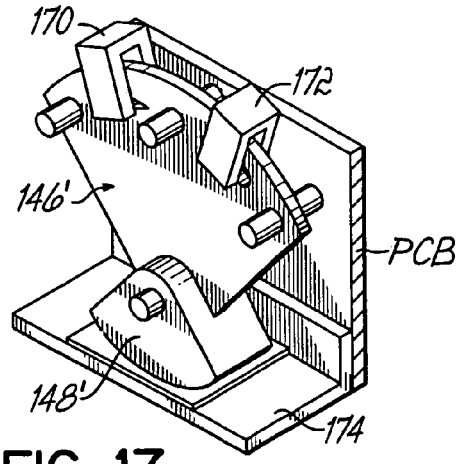
FIG. 17 is another form of the mask used in the tilt sensor system of the present invention.

Another form of mask is shown in FIG. 17 as mask 146'. Mask 146' has a light emitter element and its corresponding light receiving element both mounted on a single element, such as elements 170 and 172 which span mask 146'. Elements 170 and 172 as well as base 148' are all mounted on a bracket 174 which is mounted on the firearm.

Figure 18:
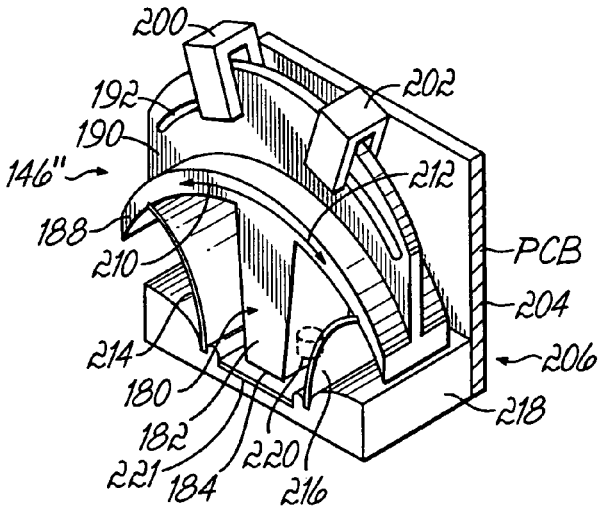
FIG. 18 is yet another form of the mask used in the tilt sensor system of the present invention.

Yet another form of mask is shown in FIG. 18 as mask 146". Mask 146" is generally similar to mask 146' and operates in a manner generally similar thereto. Mask 146" includes a T-shaped body 180 having a central portion 182 and a curved top portion 188 on the end of central portion 182 opposite to a bottom wall 184. A curved top plate 190 having light transmitting-holes 192 defined therethrough is located on top portion 188. Light sensor arrays 200 and 202 are fixedly mounted on wall 204 of base 206 and light is transmitted from one portion of each array and is received by another corresponding portion of the same array. Plate 190 is interposed between each light source and its corresponding light receiver of each array to permit the light transmission/receipt function of each array when a hole 192 is located between a light transmission element and its corresponding light receiving element of an array, and to interrupt the light transmission and receipt operation when the holes are not so positioned.

Base 180 moves in directions 210 and 212 generally about an imaginary pivot due to the bending of thin, flexible plates 214, 216 which connect top portion 188 to bottom 218 of base 206. This will open or occlude the light transmission paths associated with arrays 200 and 202. Mask 146" is mounted on a firearm to cause the just-mentioned pivoting when the firearm is tilted out of a desired upright orientation so the above-discussed accuracy and repeatability are achievable by the user. A magnet 220 is attached to bottom 184 of central portion 182 and is attracted to a lower, metallic plate 221 to dampen the side-to-side motion. The sensor arrays 200 and 202 are connected to the signal circuits as discussed above.

Switches

Figure 20:
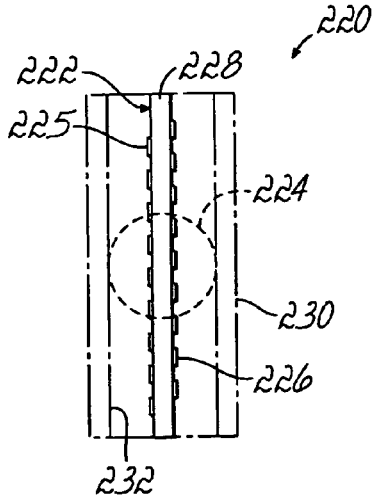
FIG. 20 is a top plan view of the sensor shown in FIG. 19.
Figure 19:
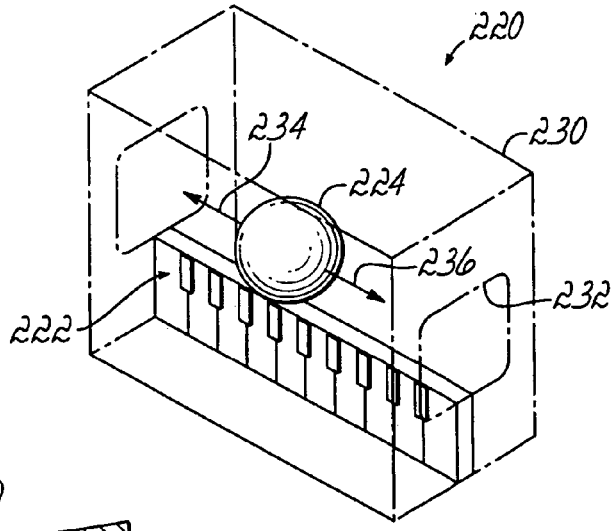
FIG. 19 is a ball and track form of the firearm tilt sensor system used in the present invention.

Yet another form of a system for controlling the signals discussed above is shown in FIGS. 19 and 20. Control unit 220 includes a multiplicity of spaced apart switches, such as switch 222, that are normally open and are closed by a moving element, such as electrically conductive ball 224, that moves in accordance with tilting movement of the firearm. The switches are part of circuits that connect the signal lights to a power source when closed. Switches on one side or the other of a centerline will activate one signal light while switches at or near the centerline will activate another signal light as discussed above. As can be seen in FIGS. 19 and 20, each switch includes two electrically conductive contacts, such as contacts 225 and 226, separated by an electrical insulator 228. A housing 230 has a bore 232 defined therethrough in which ball 224 moves in directions 234 or 236 depending on the tilt of a firearm on which housing 220 is mounted. Housing 220 is mounted on the firearm to cause ball 224 to move when the firearm is tilted as above discussed.

Figure 21:
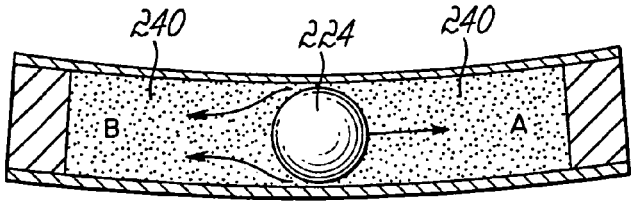
FIG. 21 shows a ball in a viscous fluid in one form of the firearm tilt sensor of the present invention.

Bore 232 can be under vacuum conditions to facilitate movement of ball 224, or can contain a fluid which will control movement of ball 224 in bore 232. A viscous fluid 240, such as light oil or the like, is shown in FIG. 21. The fluid will damp, or control movement of ball 224.

Figure 22:
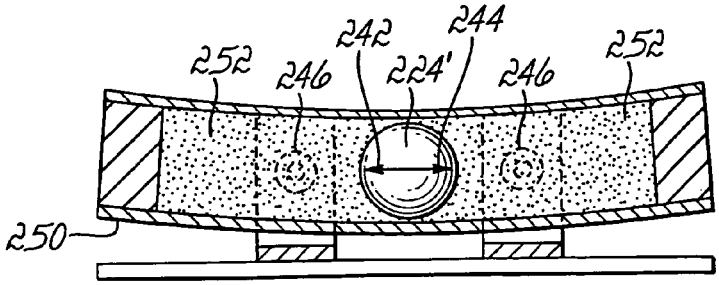
FIG. 22 illustrates the ball/viscous fluid form of the invention in combination with optical sensors.
Figure 25:
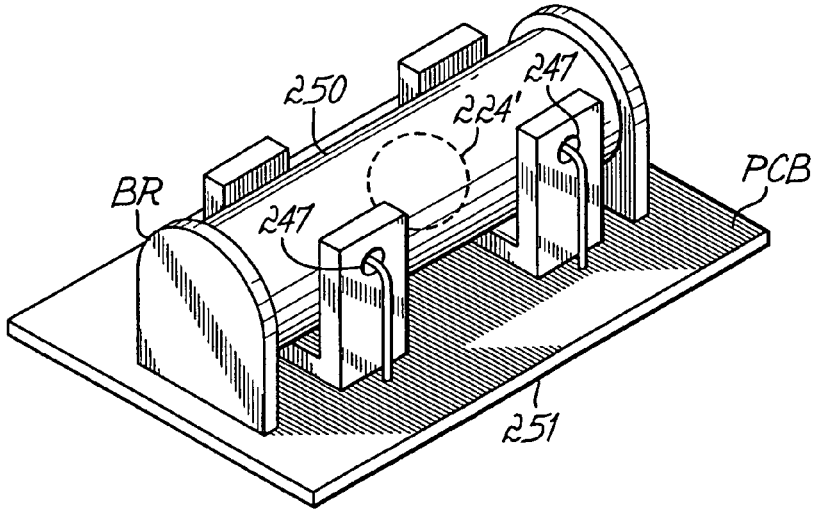
FIG. 25 shows a sensor array similar to that shown in FIG. 19 in a mountable form.

As indicated in FIGS. 22 and 25, a ball 224' can serve the same purpose as masks 146, 146' and 146" and is positioned to move in directions 242 and 244 along a path that is interposed between a light transmitter and a light receiver, such as optical sensors 246 and light generators 247. Ball 224' is contained in an optically transparent container, such as tube 250, which is either under a vacuum or contains a viscous fluid 252 to control movement of ball 224'. Tube 250 is mounted by a base unit 251 and braces BR to cause ball 224' to move in response to tilting of the firearm while light associated with sensor/transmitter arrays that are located on tube 250 activate signals as discussed above to indicate to a user when the firearm is properly oriented or is tilted in an undesired manner.

Inductance Systems

As discussed above, many methods can be used to sense tilt of the firearm and translate that sensing to signals that are displayed to a user in his secondary concentration. One of these methods includes inductance and the change in inductance as the firearm is tilted.

Figure 23:
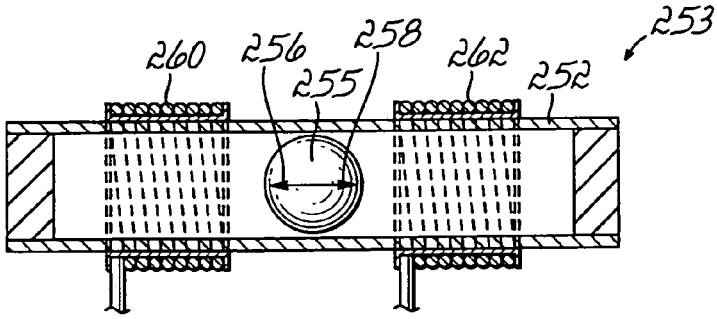
FIG. 23 illustrates a coil form of the firearm tilt sensor of the present invention.
Figure 24:
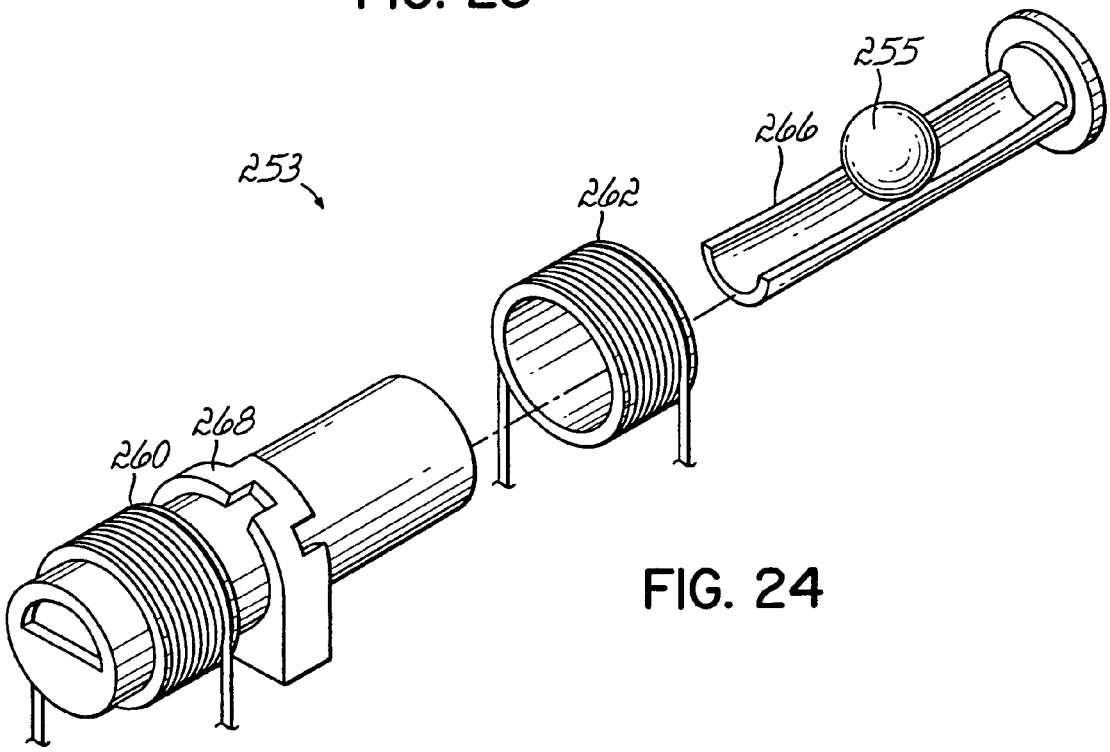
FIG. 24 is an exploded perspective view of the coil form of the sensor shown in FIG. 23.

A means for sensing firearm tilt is shown in FIGS. 23 and 24 as impedance means 253. Means 253 includes a hollow tube 254 which is mounted on a firearm to tilt about a tube transverse axis when the firearm is tilted as discussed above. Means 253 utilizes the coil concept discussed above and a movable electrically conductive element, such as metal ball 255, is movably located inside tube 254 to move along a longitudinal centerline of that tube in directions 256 and 258 as the firearm is tilted. Coils, such as coils 260 and 262, are mounted on tube 254 at locations that are spaced apart along the longitudinal centerline. The coils are part of circuits, such as the bridge circuit shown in FIG. 26 and discussed below, that are altered when an electrically conductive element, such as ball 255, passes through the coil. The circuits are connected to the indicators discussed above so when the firearm is in a desired orientation, one signal is activated, and another signal is activated when the ball is moved by the firearm being in an undesired orientation. Ball 255 moves along a track 266 which can be curved if desired, and spacer elements, such as element 268, separate adjacent coils so adjacent coils do not interfere with each other, or the circuits associated therewith.

Alternative Inductance Bridge Circuit

Figure 26:
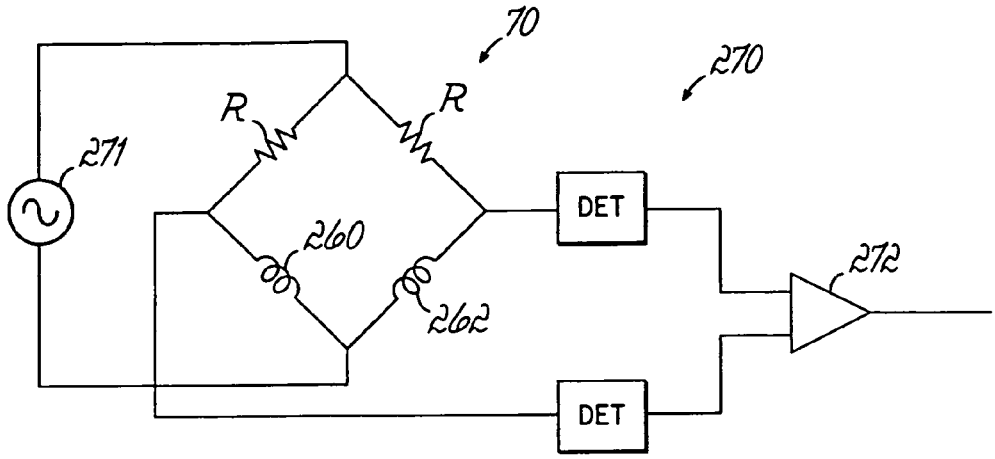
FIG. 26 is a schematic of a bridge circuit and is another form of the circuit shown in FIG. 8 and which includes an amplifier.

As discussed above, measurement of the inductance associated with the systems using coils to sense tilt can be carried out in various ways, including bridge circuits such as illustrated above in FIG. 8B. Another bridge circuit 270 is shown in FIG. 26 connects coils 260 and 262 and is stimulated with a frequency source 271 to detect and amplify the voltage in the bridge. This voltage, if in balance (i.e. zero) would indicate "level". As the ball moves toward a given coil, the inductance increases and more current is shunted through it. This would be observed in the bridge as an imbalance. This imbalance is detected (via a diode detector or other method) and, if necessary, amplified via amplifier 272. The sign and magnitude of the detected voltages indicate the position of the ball within the tube. As discussed above, filter circuits can also be included and the filters could be stimulated and the responses compared. The stimulus could include impulse or step functions and the harmonic content compared.

Overall System

Figure 27:
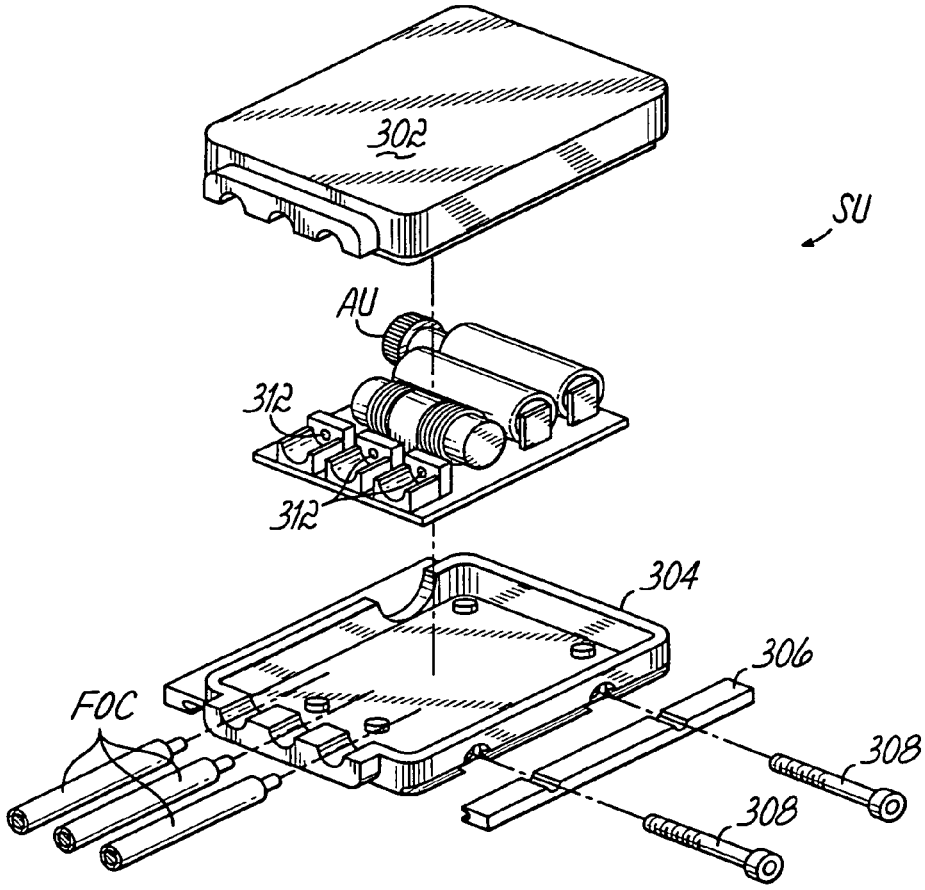
FIG. 27 is an exploded perspective view of a level sensor in combination with a scope and a housing.

An overall arrangement for the tilt sensor which is the subject of this disclosure is shown in FIGS. 7 and 27 as unit SU. Unit SU includes a housing having a top cover 302 and a base element 304 which is mounted on a firearm to tilt therewith. Base element 304 is mounted on a firearm by a clamp element 306 which includes threaded fasteners, such as bolts 308 for attaching the clamp to the base unit and on the firearm. Fiber optic cables FOC extend into the housing to receive appropriate input from a light generating element, such as an LED 312, an incandescent lamp or the like, via control circuits such as discussed above and to transmit such light to the indicators such as the indicators discussed above. An adjustment unit AU is also located in housing 300.

Accelerometer Embodiment

Figure 28:
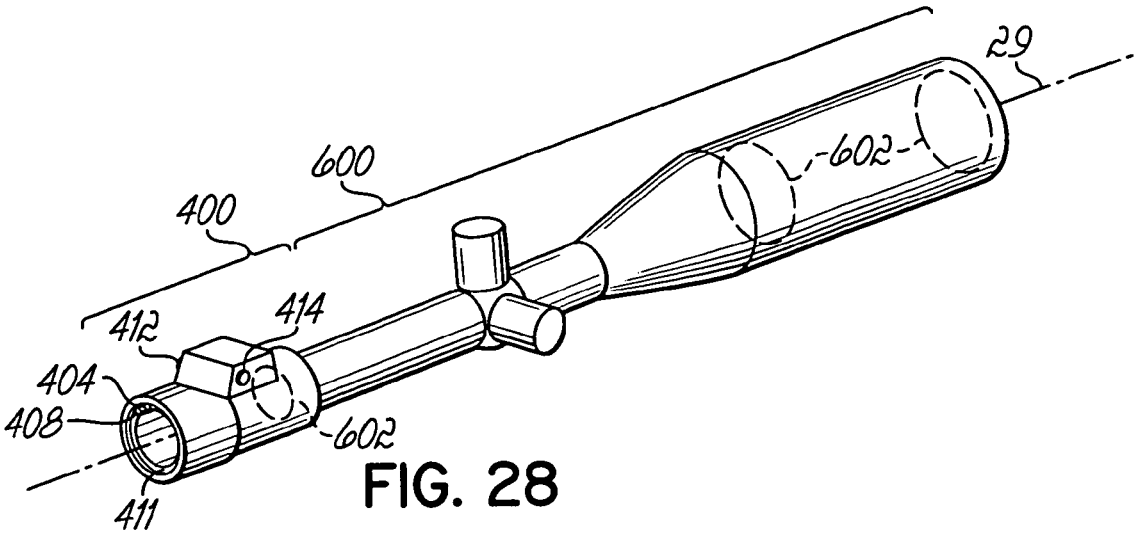
FIG. 28 is a perspective view of a tilt indicator coupled to the scope of a rifle.
Figure 29:
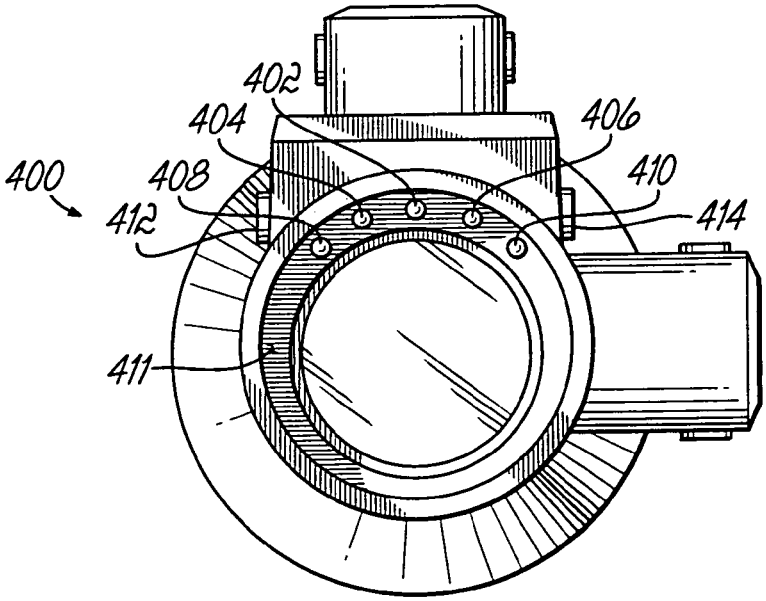
FIG. 29 is an end view of the tilt indicator shown in FIG. 28 and taken along line 29-29.

Referring to FIGS. 28-31, another embodiment interfaces an accelerometer 512 with a controller 514 and signal indicators 402-410 to unobtrusively communicate tilt information to a user of a scope 600 or other sighting device. Generally, the ocular housing of the tilt indicator 400 illustrated in FIG. 29 employs the accelerometer 512 and other tilt sensing circuitry to convey orientation information to the user via at least one signal indicator. As shown in FIG. 29, the peripheral positioning of the signal indicator(s) 402-410 ensures they do not obstruct visual target acquisition when removably attached to a rifle scope 600, as shown in FIG. 28. As may be appreciated, the battery operated tilt indicator 400 is configured to mount onto a scope housing 600 of FIG. 28 with the signal indicators 402-410 (FIG. 29) recessed on an annular ring 411 and oriented in any suitable fashion. Tilt indicator 400 is preferably positioned behind all optical elements or optics 602 of housing 600 as shown in FIG. 28. This helps ensure that only the shooter's peripheral vision is used to view signal indicators 402-410.

Figure 30:
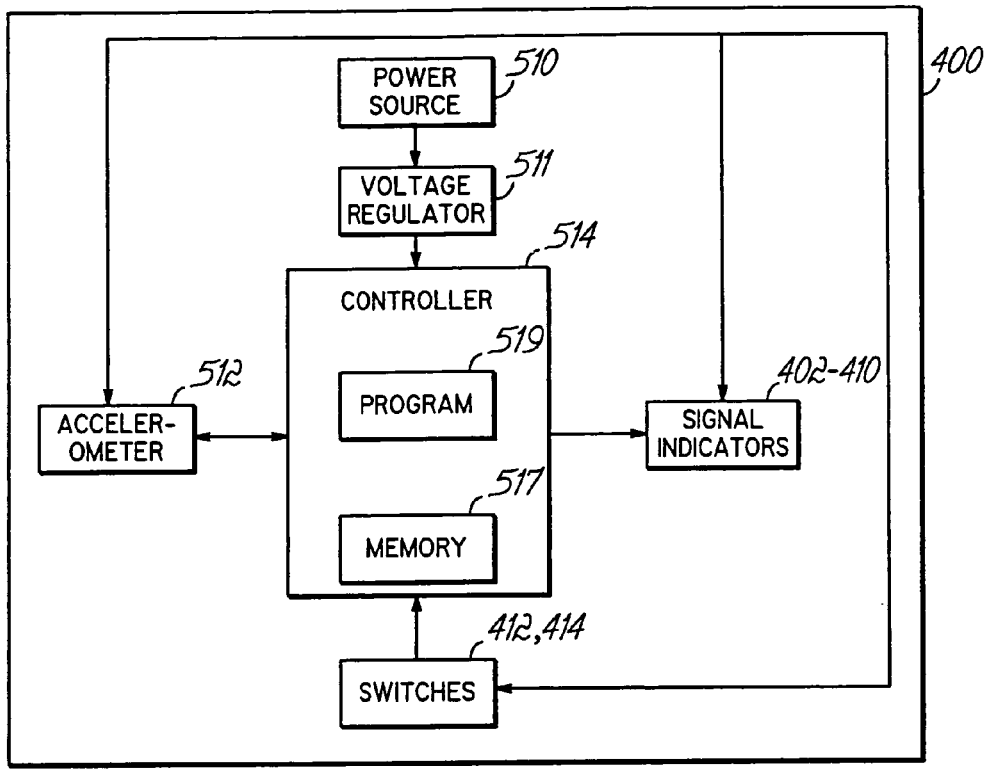
FIG. 30 is block diagram generally showing a hardware circuit suited to execute processes associated with the tilt indicator of FIG. 29.

During targeting, a controller 514 shown housed within the tilt indicator 400 of FIGS. 29 and 30 may electronically activate one or more signal indicators 402-410, such as a bank of light emitting diodes (LEDs) as illustrated particularly in FIG. 29. Other embodiments may incorporate liquid crystal technology or other visual indication technology. In any case, the signal indicators 402-410 may communicate to the user an approximate degree of tilt relative to a zero reference point. As such, a program executed by the controller 514, or suitable microprocessor, of FIG. 30 may initiate activation of a particular signal indicator 402-410 in response to circuitry sensing an angular orientation or a specified range of angular orientation. For instance, one signal indicator 402 shown in FIG. 29 may illuminate when the tilt indicator 400 is oriented within 1° of the reference point. The signal indicators 402-410 may further convey the direction of tilt in one axis relative to the zero reference point.

The user may also adjust settings of the tilt indicator 400 to include a desired zero reference point, which may or may not reflect a true horizontal orientation. Other configurable parameters accessible via an interface of the tilt indicator 400 include the reported tolerance of tilt, or resolution mode. As discussed below, the resolution mode of tilt indicator 400 refers to a scale or range of tilt measurements that define the activation of signal indicators 402-410. The resolution mode feature accommodates different applications and user preferences by allowing adjustment between different tilt measurements. Consequently, the user may select resolution modes having smaller or larger range tolerances for tilt measurements depending on whether the user demands more or less precision, respectively. Additionally, the user may operate switches or buttons 412, 414 (FIG. 29) to manipulate the brightness of the signal indicators 402-410 to account for different environments and user preferences.

Each button 412, 414 is configured to receive user input regarding parameter preferences. As such, an operator may adjust settings to account for different circumstances, such as lighting, application and preference. For convenience and space considerations, a user may manipulate multiple parameters using a single button. For example, the duration for which the user depresses a button may prompt different display options.

More particularly, a first button 412 may initiate procedures within the controller 514 shown in FIG. 30 that shutdown/power-up and reinitialize memory 517 and other processes. The first button 412 of FIG. 29 may additionally actuate a switch that controls signal indicator 402-410 brightness. Using the button 412 as discussed below in detail, the user may toggle through a sequence of brightness levels until settling on one that accounts for environmental conditions and user preference.

A second button 414 of FIG. 29 allows the user to sequence through different resolution modes. Resolution modes may correspond to a level of tilt measurement precision required by a specific application. For instance, a center, green signal indicator 402 may flash during setup to indicate the most sensitive or precise resolution setting. Such a mode may be appropriate for bench rest applications in that it allows only 2.5° of imprecision in either direction relative to the zero reference point.

Similarly, two yellow signal indicators 404, 406 may flash during setup to indicate an intermediate resolution mode appropriate for field shooting. Field shooting may generally tolerate 2°-5° of tilt in each direction relative to the zero reference point, a range registered by the intermediate mode. Blinking red lights 408, 410 communicate the least precise resolution mode. This mode may allow a free-hand shooter to utilize the embodiment by tolerating nearly 10° of tilt in either direction. As discussed below, a user may select and recall a resolution mode using the mode button 414 after experimenting with different modes to determine personal preferences for different applications.

Resolution mode selection dictates the level or degree of imprecision communicated to a shooter via the signal indicators 402-410. That is, in addition to communicating the current mode setting to a user during initialization, the signal indicators 402-410 of the embodiment communicate or convey the relative degree and direction of tilt while aiming and firing the firearm. For example, when operating in any of the above three resolution modes, a single signal indicator 402-410 may illuminate to indicate the direction of tilt relative to the zero reference point. The illumination of only one indicator 402-410 at any given time further serves to conserve battery longevity and limit shooter distraction.

More particularly, the green signal indicator 402 will light when the tilt indicator 400 is within a specified angular range of the zero reference point corresponding to a given resolution mode. As discussed herein, the angular range is specified according to the operating resolution mode. Generally, however, illumination of the green signal indicator 402 conveys to the user that the scope is within the most precise, or narrow, angular range of the selected resolution mode. A yellow signal indicator 404, 406 may illuminate in response to the measured tilt falling outside of the specified angular range, but still within some intermediate angular range.

Further, a yellow signal indicator 404 or 406 will illuminate depending on the direction of measured tilt. In this manner, the feature facilitates correction of a tilt scenario at the same moment it signals the error. Should the measured tilt register outside of the intermediate range, a red signal indicator 408 or 410 in the direction of the recorded tilt will illuminate. Preferably, signal indicators 402-410 will not illuminate whenever the tilt of the scope exceeds the range prescribed by the least precise mode.

As discussed above, the tolerated ranges of the described signal indicator applications will vary according to the resolution mode in which the tilt indicator 400 operates. For instance, high precision mode will enable the green signal indicator 402 so long as the level indicator 400 remains oriented within 2.5° in either direction of the zero reference point. Alternatively, intermediate resolution mode may expand this range by a degree so that the green signal indicator 402 lights while the scope is within 3.5° of the reference point in either direction. Finally, the least precise resolution mode allows for four degrees of variation in any direction of the zero reference point, while still illuminating the green signal indicator 402. As such, each of the three resolution modes have different, scaled tolerances that the controller may convey via illuminated signal indicators 402-410.

The mode selection button 414 additionally enables the user to set the zero reference point used to calculate tilt. This feature capitalizes on programming within conventional accelerometers to accommodate shooting scenarios where a user requires an orientation other than true zero, i.e., a true horizontal orientation. As such, both buttons 412, 414 may act in tandem to control the power, brightness, level setting and other parameters of the tilt indicator 400.

The block diagram of FIG. 30 shows an exemplary circuit layout configured to execute process steps associated with the tilt indicator 400 of FIG. 29. Generally, a power supply 510, which may include two lithium-ion batteries, supports a circuit that additionally includes a voltage regulator 511, an accelerometer 512, controller 514, switches 412, 414 and a bank of signal indicators 402-410. To initiate a given shooting session, a user may actuate a switch 412 or 414 via a button or other suitable interface component of the tilt indicator 400. The activated switch 412 or 414 completes a circuit to the controller 514. Of note, a suitable controller 514 may embody a microprocessor or CPU, preferably one having an associated memory 517.

The resultant signal transmitted to the controller 514 of FIG. 30 may cause it to retrieve stored settings and coefficients from its memory 517. As part of, or immediately following such initialization processes, the controller 514 may provoke the illumination of the signal indicators 402-410. For instance, select indicators may flash in such a manner as to indicate a current operating mode of the tilt indicator 400.

The controller 514 may subsequently transmit a command to the accelerometer 512 instructing it to sample the orientation of the tilt indicator 400 relative to a specified, zero reference point. In response, the exemplary accelerometer 512 may output signals having duty cycles comprising a ratio of pulse width to period. As such, the duty cycles are proportional to acceleration and formatted to be immediately processed by the controller 514. The controller 514 may repetitively average and record accelerometer 512 output in memory 517 to improve noise margins. As discussed above in detail, an exemplary accelerometer 512 includes an offset feature that the embodiment exploits to allow a user to adjust zero reference.

The controller 514 executes program code 519 to process the accelerometer 512 output according to an algorithm discussed below in detail. The controller 514 of FIG. 30 further converts the degree of tilt gleaned from the algorithm into a signal operable to selectively activate signal indicators 402-410. For instance, the signal may illuminate an indicator appropriate to communicate a degree and direction of tilt to a user for a given resolution mode.

As discussed herein, a user may activate a switch 412 or 414 to configure parameters of the tilt indicator 400. The controller 514 of FIG. 30 identifies the origin and duration of the switch 412 or 414 initiated signal to adjust brightness, power, mode and reference settings. The program 519 of the embodiment may communicate such parameters to the user via the bank of signal indicators 402-410. Further, the controller 514 may store applicable settings and coefficients in anticipation of a next session.

Figure 31:
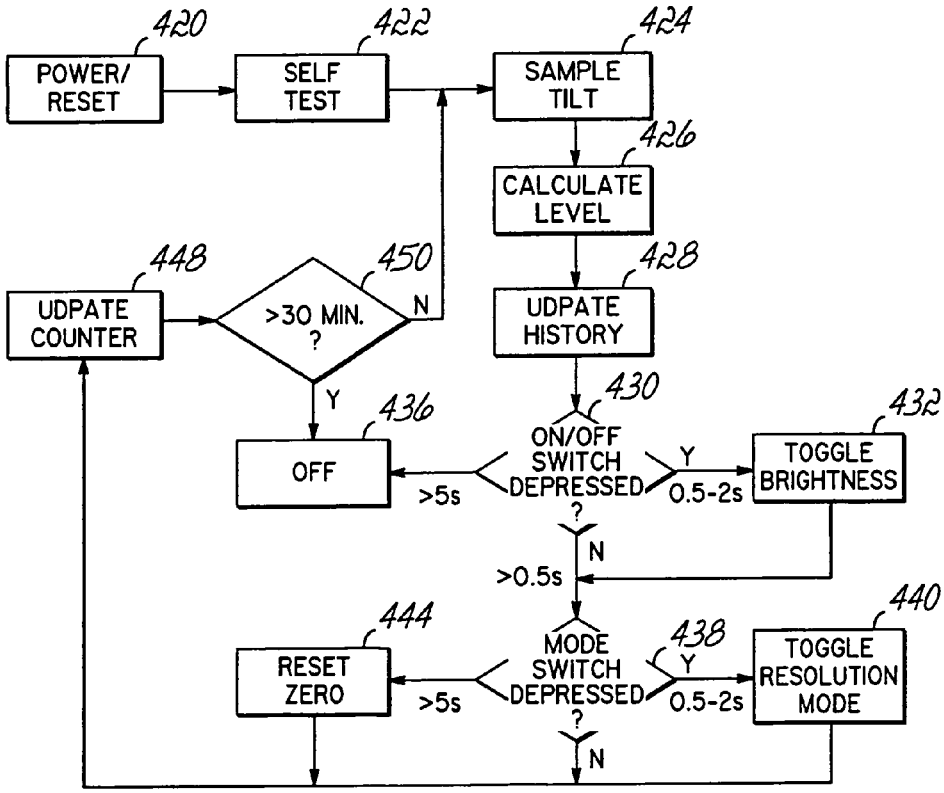
FIG. 31 is a flow chart illustrating sequence steps suited to configure and utilize the tilt indicator of FIG. 29.

The flowchart of FIG. 31 shows sequence steps associated with such a session. More specifically, the flowchart illustrates an exemplary processing cycle for setting and displaying parameters of the tilt indicator 400 (FIG. 29) in such a manner as to unobtrusively convey tilt angle. Turning more particularly to block 420 of FIG. 31, the user may depress the first, on/off, button 412 (FIG. 29) of the tilt indicator 400. As discussed in the text accompanying FIG. 30, the button may activate a switch 412 that, in turn, initializes a controller 514 and associated memory 517 contained within the circuitry of the apparatus. Such initialization processes include preparing the controller 514 to receive stored coefficients from memory 517. Exemplary coefficients may relate to saved reference points, modes, brightness levels and other preferences. A user may depress the button at block 420 of FIG. 31 when initially turning the apparatus on, beginning a new cycle, or powering down.

At block 422 of FIG. 31, the controller 514 of FIG. 30 may initiate self-test procedures to ensure proper configuration and operation. In one instance, the embodiment may rely on the generation and evaluation of checksum values. For example, the memory component of the controller may retrieve a unique sequence of numbers for verification purposes. The controller may initiate such evaluation and relate proper operation to the user by illuminating signal indicators in a unique, start-up sequence.

An exemplary sequence may involve the signal indicators flashing at block 422 to remind the user of the current resolution mode setting. The current mode setting may correspond to the last mode setting specified by the user. For example, if a user last operated the tilt indicator while in high precision resolution mode, then the green signal indicator 402 of FIG. 29 may flash. While such a default is convenient for users who demonstrate a consistent mode preference, the embodiment presents a user with the opportunity to switch modes as discussed below at block 440 of FIG. 31.

Following setup at block 424, the tilt circuitry contained within the ocular housing may sample the relative orientation of the tilt indicator. Namely, the controller sends a command to the accelerometer circuitry causing it to sample the orientation of the scope at block 424. Of note, the tilt measurement is conducted relative to the zero reference point retrieved from memory at block 420. As discussed below, the accelerometer responds by outputting duty cycle data to the controller. The controller repetitively samples and averages such data to ensure application timing requirements and improve noise margins. The controller may further record the accelerometer output at block 424.

Of note, the output from the accelerometer may incorporate an offset factor. Such an offset may allow the user to set or orient an independent zero reference point for the accelerometer, independent of gravitational orientation. The present embodiment exploits this feature to accommodate shooter preferences or requirements that mandate that the scope not be oriented at true zero, that is, aligned with gravity. At some point during installation, the user may determine what offset, if any, they require. In this manner, the accelerometer may adjust readings using the offset to reflect the user specified zero reference point.

As such, level measurements reported by the signal indicators will reflect the offset value. For instance, the user may wish to orient the indicator 5° off of true zero for a specific application. As such, if the accelerometer of the scope has an offset of minus 5°, then 5° will be subtracted from a recorded, true tilt measurement. The controller then records the resultant tilt reading at block 424 and uses it to determine a level measurement at block 426.

More particularly, the controller may execute program code at block 426 embodying the following algorithm: ARCSIN[$(t_1/t_2-0.5)/0.125$]. In the equation, $t_1$ and $t_2$ are duty cycles of the accelerometer. The subtracted 0.5 value embodies a normalizing factor of the accelerometer, while the 12.5% in the denominator of the equation is a preferred scaling factor. The accelerometer outputs both duty cycles, $t_1$ and $t_2$ (ratios of pulse width to period), as analog signals. A counter of the controller interprets and manipulates the output according to the above equation.

Of note, the function of the arcsin embodies the acceleration of the accelerometer, which the ARCSIN function converts into a tilt measurement reported in degrees. As tilt is nonlinear with acceleration, the embodiment uses the equation to reasonably approximate tilt. As can be appreciated, a preferred embodiment may store and recall tilt measurements in a lookup table accessible by the controller. Such a configuration requires fewer processing cycles of the controller.

Having calculated the measurement level at block 426, the embodiment may update the user display at block 428. Namely, the controller may translate the degree of the tilt calculated at block 426 into signal indicator responses digestible by the user. For instance, the processor may associate the tilt measurement with a signal configured to prompt the illumination of an appropriate signal indicator. If operating in high precision mode, for example, the embodiment may illuminate the center, green signal indicator so long as the shooter maintains an attitude within 2.5° of zero reference in either direction. Should the level measurement stray outside of this range, but still remain within five degrees of the reference point, the controller may generate another signal configured to light a yellow signal indicator.

The controller may further select the signal indicator on the side of the display corresponding to the angle of tilt. In this manner, the tilt indicator not only transparently relates a relative measurement of tilt, but also the direction of the imprecision. If the calculated tilt measurement exceeds 5° in either direction of zero reference while still operating in precision mode, then the controller may cause a red signal indicator to light. As above, the selected signal indicator may reflect the direction of the tilt.

Additionally, the degree of imprecision tolerated by the tilt indicator will vary according to the operating mode of the user. For instance, the indicator may display a yellow signal indicator for a shooter within 8° of zero while in off-hand, or the least precise resolution mode. When operating in intermediate, or field resolution mode, the same 8° of imprecision may instead illuminate a red signal indicator.

After or prior to an initial use, the user may wish to adjust parameters of the display at blocks 430 and/or 438. As discussed in the text accompanying block 420, brightness and resolution parameters retrieved from memory may serve initially as default settings. As such, the settings may reflect the setting used in a last application. They may alternatively include factory default values. The present embodiment nonetheless enables the user to adjust these settings to account for different circumstances, such as lighting, application and mood. For convenience and space considerations, a user may manipulate multiple parameters using a single button. In a preferred embodiment, the duration for which the user keeps the button depressed may prompt different display options.

More particularly, a user may depress the first button for some interval between one half and two seconds to select a brightness level at block 430. As discussed above, brightness refers to the light intensity of the signal indicators. Optimal intensity may vary as a product of both environmental conditions, such as sun position, as well as user preference. The controller may register the duration that the button is depressed and generate a toggle command, accordingly.

In response to receiving the command, the controller may cause the signal indicators to sequence through four different brightness levels at block 432 until the user selects one by repressing the button. Of note, the command may activate different combinations of resisters in series with the bank of signal indicators in order to achieve varying levels of brightness. The controller may then store the selected brightness level within its memory. As discussed above, the tilt indicator may default to the stored brightness level when reset at block 420.

Should the user hold the on/off button down for more than five seconds at block 430, then the controller may power-down the tilt indicator at block 436. More particularly, the button may release a switch and initiate shutdown procedures within the controller. For convenience, a hysterisis loop in the level display circuitry may prevent the brightness from toggling if the on/off button is continuously depressed for over two seconds.

Should the on/off button be ignored altogether, or depressed for less than half of a second at block 430, then the embodiment may allow the user to proceed directly to configuring resolution mode. As such, the embodiment allows users to bypass brightness configuration. In this manner, the user proceeds directly to mode selection at block 438. Of note, the half of a second tolerance may be built-in to account for an inadvertent bumps, so that accidental contact does not disrupt a shooting sequence. That is, accidental contact with the button that results in it being depressed less than a half a second will not initiate brightness or shutdown operations.

A user may similarly adjust the mode in which the tilt indicator operates at block 438. As discussed above, resolution mode refers to the range of tilt tolerated for a specific application. For instance, an off-hand shooter may consider a gun tilt of seven degrees acceptable, while a bench shooter using a sandbag for stability may consider only one degree of variation appropriate. To adjust mode accordingly, the user may depress the mode button 414 shown in FIG. 29. As with the above discussed brightness selection, the duration of time the user holds down the button may cause the circuitry to offer different configuration options.

More particularly, the user may manipulate operating mode by depressing the mode button at block 438 for at least some minimum interval, such as a half a second. As such, the embodiment will sequence through mode settings at block 440 until the user presses the button again to indicate a selection. For instance, the green signal indicator may flash to communicate the availability of high precision mode. Should the user not desire such resolution, they may wait for both yellow lights of the tilt indicator to simultaneously flash for five times (for 0.25 seconds each) to indicate intermediate precision mode.

The user could repress and release the mode button to select intermediate resolution mode, should the shooting application call for field-level accuracy. Otherwise, the tilt indicator may next flash the red signal indicators to signify a least precise mode. The user may select this mode as before, or wait for the embodiment to toggle back to the green signal indicator, which corresponds to high precision mode. In a preferred embodiment, each set of signal indicators may flash five times before sequencing to the next mode. As before, the embodiment may incorporate the minimum, half-second interval that the user must hold down the mode button to account for jarring and inadvertent bumps.

Should the user depress the mode button for longer than five seconds at block 438, then the tilt indicator apparatus may acquire and set a new zero reference point at block 444. This feature allows the user to tailor the orientation of their gun from conventional, true zero to accommodate different shooting requirements. The embodiment may further store the updated zero reference point within controller memory. As such, the controller will recall the zero value when calculating tilt at block 426. As with the on/off button, the user may elect to bypass the mode reconfiguration and/or zero reset functions altogether, by not depressing the mode button. Also as above, a hysterisis loop in the level display circuitry may prevent the signal indicators from toggling through resolution modes if the button is continuously depressed for over two seconds.

In either case, the embodiment may cycle through a runtime counter at block 448. The counter, which may embody a conventional clock or other timing mechanism, registers quantities of time passing in between activation of switches via the on/off or mode buttons. For instance, block 450 may determine that the user has not adjusted the brightness, mode or zero value for a period exceeding thirty minutes. In response, the counter may send a signal to the controller, which in turn, initiates shutdown procedures at block 436.

Of note, the exemplary thirty minute period may be adjusted by the user and/or reflect some factory setting. Such a counter feature serves to preserve battery life in the event that the user neglects to turn the tilt indicator off in between applications. Where the period of inactivity does not exceed thirty minutes, the embodiment cycles back to block 424, where the level of tilt is recalculated and the user display is updated for the user.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicant's general inventive concept.

What is claimed is:

1. Apparatus for indicating tilt of a shooting instrument operated by a user in conjunction with a scope having optical elements therein including an ocular lens positioned closest to the user, comprising:

a) a mounting element configured to be mounted to the shooting instrument;

b) a signal indicator coupled to said mounting element and including first and second visual indicators located peripherally outside of the ocular lens of the scope utilized by the user's central vision to focus on a target when the mounting element is mounted to the shooting instrument; and c) an instrument level indicating control operatively coupled to said first and second visual indicators, said control including electronic tilt sensing circuitry operative to 1) activate the first visual indicator to indicate a non-level orientation of the shooting instrument to the user's left, 2) activate the second visual indicator to indicate a non-level orientation of the shooting instrument to the user's right, and 3) deactivate the first and second visual indicators when the user achieves a level orientation of the shooting instrument.

2. The apparatus of claim 1, wherein said first and second visual indicators further comprise light emitting diodes.

3. The apparatus of claim 1, wherein the first and second visual indicators are further configured to be located behind all of the optical elements of the scope.

4. The apparatus of claim 1, wherein said tilt sensing circuitry senses when the shooting instrument is oriented at an angle to the user's left or right relative to a zero reference point.

5. The apparatus of claim1, wherein said first visual indicator further comprises a liquid crystal indicator.

6. The apparatus of claim 1, wherein said first visual indicator further comprises a light.

7. Apparatus for indicating tilt of a shooting instrument operated by a user in conjunction with a scope having optical elements therein including an ocular lens positioned closest to the user, comprising:

a) a mounting element configured to be mounted to the shooting instrument;

b) a signal indicator coupled to said mounting element and including first and second visual indicators located peripherally outside of the ocular lens of the scope utilized by the user's central vision to focus on a target when the mounting element is mounted to the shooting instrument; and c) an instrument level indicating control operatively coupled to said first and second visual indicators, said control including electronic tilt sensing circuitry operative to 1) activate the first visual indicator to indicate a level orientation of the instrument, and 2) deactivate the first visual indicator to indicate a non-level orientation of the instrument to the user's right or left.

8. The apparatus of claim 7, wherein said first visual indicator further comprises a light emitting diode.

9. The apparatus of claim 7, wherein said first visual indicator is further configured to be located behind all of the optical elements of the scope.

10. The apparatus of claim 7, wherein said tilt sensing circuitry senses when the shooting instrument is oriented at an angle to the user's left or right relative to a zero reference point.

11. The apparatus of claim 7, wherein said first visual indicator further comprises a liquid crystal indicator.

12. The apparatus of claim 7, wherein said first visual indicator further comprises a light.

13. Apparatus for indicating tilt of a shooting instrument operated by a user in conjunction with a scope having optical elements therein including an ocular lens positioned closest to the user, comprising:

a) a mounting element configured to be mounted to the shooting instrument;

b) a signal indicator coupled to said mounting element and including first and second visual indicators located peripherally outside of the ocular lens of the optical elements of the scope utilized by the user's central vision to focus on a target when the mounting element is mounted to the shooting instrument; and c) an instrument level indicating control operatively coupled to said first and second visual indicators, said control including electronic tilt sensing circuitry operative to 1) activate the first visual indicator to indicate a non-level orientation of the instrument to the user's left, 2) activate the second visual indicator to indicate a non-level orientation of the instrument to the user's right, and 3) activate a level indicator when the user achieves a level orientation of the instrument.

14. The apparatus of claim 13, wherein said level indicator further comprises a third visual indicator.

15. The apparatus of claim 13, wherein said level indicator further comprises an indicator of varying visual intensity to show a varying degree of tilt relative to a zero reference.

16. The apparatus of claim 13, wherein said level indicator further comprises a flashing indicator.

17. The apparatus of claim 13, wherein two lights are activated when the shooting instrument is within a predetermined angular range of the level orientation.

18. The apparatus of claim 13, wherein said first and second visual indicators further comprise light emitting diodes.

19. The apparatus of claim 13, wherein the first and second visual indicators are further configured to be located behind all of the optical elements of the scope.

20. The apparatus of claim 13, wherein said tilt sensing circuitry senses when the shooting instrument is oriented at an angle to the user's left or right relative to a zero reference point.

21. The apparatus of claim13, wherein said first and second visual indicators further comprise liquid crystal indicators.

22. The apparatus of claim13, wherein said first and second visual indicators further comprise lights.

* * * * *